US008172363B2

(12) United States Patent
Mills et al.

(10) Patent No.: US 8,172,363 B2
(45) Date of Patent: May 8, 2012

(54) APPARATUS AND METHODS FOR FULL-WIDTH WIDE FORMAT INKJET PRINTING

(75) Inventors: Michael D. Mills, Moultonborro, NH (US); Paul Alan Duncanson, Franklin, NH (US)

(73) Assignee: Electronics for Imaging, Inc., Foster City, CA (US)

( * ) Notice: Subject to any disclaimer, the term of this patent is extended or adjusted under 35 U.S.C. 154(b) by 344 days.

(21) Appl. No.: 12/628,853

(22) Filed: Dec. 1, 2009

(65) Prior Publication Data

US 2010/0073424 A1 Mar. 25, 2010

Related U.S. Application Data

(62) Division of application No. 11/425,867, filed on Jun. 22, 2006, now Pat. No. 7,673,965.

(51) Int. Cl.
*B41J 2/155* (2006.01)

(52) U.S. Cl. ..... 347/42; 347/40; 347/49

(58) Field of Classification Search ..... 347/9, 12, 347/20, 40, 42, 47–49
See application file for complete search history.

(56) References Cited

U.S. PATENT DOCUMENTS

| | | | | |
|---|---|---|---|---|
| 4,759,647 | A | 7/1988 | Helinski et al. | |
| 5,428,375 | A | 6/1995 | Simon et al. | |
| 5,750,004 | A | 5/1998 | Wurz et al. | |
| 6,120,142 | A | 9/2000 | Eltgen et al. | |
| 6,164,747 | A | 12/2000 | Yashima et al. | |
| 6,189,991 | B1 | 2/2001 | Wen et al. | |
| 6,234,605 | B1 | 5/2001 | Hilton | |
| 6,293,651 | B1 | 9/2001 | Sawano | |
| 6,869,166 | B2 | 3/2005 | Brugue et al. | |
| 7,083,255 | B2 * | 8/2006 | Shibata et al. | 347/40 |
| 7,360,866 | B2 * | 4/2008 | Kitagawa et al. | 347/40 |
| 2005/0140765 | A1 | 6/2005 | Masumi et al. | |
| 2007/0296757 | A1 | 12/2007 | Mills et al. | |

FOREIGN PATENT DOCUMENTS

| | | |
|---|---|---|
| DE | 4020129 | 1/1992 |
| EP | 0938976 | 9/1999 |

* cited by examiner

*Primary Examiner* — Thinh Nguyen
(74) *Attorney, Agent, or Firm* — Michael A. Glenn; Glenn Patent Group

(57) ABSTRACT

Apparatus and methods are provided for wide format inkjet printing using conventional piezoelectric inkjet print heads that each print at a native resolution. A plurality of inkjet print heads are disposed in a print head array to print an image on the substrate at the native resolution across an entire width of the substrate without scanning across the width of the substrate. The print head array may be shifted in a direction parallel to the width of the substrate, and the print head array may be used to print images on the substrate in multiple passes to form a composite image having a resolution equal to a multiple of the native resolution. Alternatively, a plurality of print head arrays may be provided, with adjacent print head arrays spaced apart to provide a composite print resolution equal to a multiple of the native resolution.

11 Claims, 31 Drawing Sheets

APPARATUS AND METHODS FOR FULL-WIDTH WIDE FORMAT INKJET PRINTING

CROSS-REFERENCE TO RELATED APPLICATIONS

The present application is a divisional application of U.S. patent application Ser. No. 11/425,867, entitled APPARATUS AND METHODS FOR FULL-WIDTH WIDE FORMAT INKJET PRINTING, filed on Jun. 22, 2006 in the name of Michael D. Mills et al., and published on Dec. 27, 2007 as U.S. Publication No. 2007-0296757 A1. The entirety of the foregoing application is incorporated herein by reference.

BACKGROUND

Wide format printing systems are adapted for printing images on large scale print media, such as for museum displays, billboards, sails, bus boards, banners, point of purchase displays and other similar print media. Some wide format print systems use drop on demand ink jet printing. In such systems, a piezoelectric vibrator applies pressure to an ink reservoir of a print head to force ink through nozzles positioned on the underside of the print head. A conventional wide format inkjet printer includes a print carriage that has a set of print heads arranged in a row along a single axis. As the carriage scans back and forth along the direction of the print head axis, the print heads deposit ink drops across the width of the substrate. An image is created by controlling the order at which the ink drops are ejected from the various inkjet nozzles.

In recent years, demand has grown for wide format printers that print at very high resolution (e.g., 600 dots per inch and higher). The print resolution of a conventional scanning wide format printer may be controlled by altering the lay-down method (or interlacing) of the dots being applied to the media by the print head carriage. That is, to achieve higher resolution, the carriage may pass over a particular area more times to allow the print heads to deposit more ink dots per unit length. Thus, increases in the print resolution of a conventional wide format printer have typically come at the expense of print speed.

An alternative wide format inkjet printer includes an array of inkjet print heads arranged along a single axis in a row that spans the entire width of the print media. Because such printers eliminate the need to scan a carriage across the width of the print media, such "full width" inkjet printers potentially could achieve high resolution without sacrificing print speed. However, conventional full width inkjet printers have gaps between adjacent print heads. Thus, although each print head may print at a specific resolution (referred to as the "native resolution"), as result of the intra-print head gaps, the media must be moved under the print heads additional times to fill in the print area associated with these gaps.

One technique to solve this problem would be to design a custom inkjet print head that spans the entire width of the print media, and that has a continuous resolution across the entire width of the print media. The problem with such a solution is that it is extremely costly to develop and manufacture such a custom inkjet print head, which would not benefit from the economies of scale that may be achieved by conventional inkjet print heads that are manufactured in high volume.

Another previously known full width wide format printer uses arrays of silicon ink chips that span the entire width of the print media. Although such printers achieve a continuous resolution across the entire width of the print media, ink chips are much more fragile than conventional piezoelectric print heads. As a result, such full width ink chip printers are more costly and less reliable than conventional inkjet printers, and suffer from frequent down time for repairs.

In view of the foregoing, it would be desirable to provide full width, wide format inkjet printers that use conventional piezoelectric inkjet print head technology, and that provide a continuous resolution across the entire width of print media. It further would be desirable to provide full width, wide format inkjet printers that provide high resolution at high speed.

SUMMARY

This invention provides apparatus and methods for wide format inkjet printing using conventional piezoelectric inkjet print heads to provide a continuous resolution across the entire width of a substrate. A first exemplary printer in accordance with this invention includes a plurality of inkjet print heads, with each print head having a native print resolution. The print heads are disposed to deposit a fluid on the substrate at the native resolution across an entire width of the substrate without scanning across the width of the substrate. In particular, the printer includes a support structure that has a long axis that spans the width of the substrate. Each of the print heads includes a plurality of inkjet nozzles that are adapted to eject a fluid, such as colored ink, onto the substrate at the native resolution. The plurality of print heads are disposed along the long axis of the support structure so that the inkjet nozzles deposit a fluid at the native resolution across the entire width of the substrate.

Alternative exemplary printers in accordance with this invention print at resolutions greater than the native resolution. In particular, a second exemplary printer in accordance with this invention includes a plurality of inkjet print heads disposed in an array to deposit a fluid on the substrate at the native resolution across an entire width of the substrate without scanning across the width of the substrate. In addition, the print head array may be shifted in a direction parallel to the width of the substrate. The plurality of print heads are used to deposit a fluid on the substrate in multiple passes. In particular, during a first pass, the print head array is located at a first position, and a first image is printed on the substrate. During a second pass, the print head array is shifted to a second position, and a second image is printed on the substrate. The distance between the first and second positions may be set so that the first and second images have a composite resolution that is greater than the native resolution.

A third exemplary printer in accordance with this invention includes multiple print head arrays, with each print head array including a plurality of inkjet print heads adapted to deposit a fluid on the substrate at the native resolution across an entire width of the substrate without scanning across the width of the substrate. Each print head array is shifted in a direction parallel to the width of the substrate relative to adjacent print head arrays. The plurality of print head arrays are used to print an image on the substrate. The distance between adjacent print head arrays may be set so that the printed image has a composite resolution that is greater than the native resolution.

A fourth exemplary printer in accordance with this invention includes multiple print head arrays, with each print head array including a plurality of inkjet print heads adapted to deposit a fluid on the substrate at the native resolution across an entire width of the substrate without scanning across the width of the substrate. Each print head array is shifted in a direction parallel to the width of the substrate relative to adjacent print head arrays. The plurality of print head arrays are used to deposit a fluid on the substrate in multiple passes. In particular, during a first pass, the plurality of print head arrays is located at a first position, and a first image is printed on the substrate. During a second pass, the plurality of print head arrays is shifted to a second position, and a second image is printed on the substrate. The distance between adjacent print head arrays, and the distance between the first and second positions may be set so that the first and second images have a composite resolution that is greater than the native resolution of the array.

A fifth exemplary printer in accordance with this invention includes multiple print head arrays, with each print head array including a plurality of inkjet print heads adapted to deposit a fluid on the substrate at the native resolution across an entire width of the substrate without scanning across the width of the substrate. Each print head array may be independently shifted in a direction parallel to the width of the substrate relative to adjacent print head arrays. The plurality of print head arrays are used to print an image on the substrate. The distance between adjacent print head arrays may be set so that the printed image has a composite resolution that is greater than the native resolution. Additionally, the print head arrays may be independently shifted to print at resolutions independent of other print head arrays.

A sixth exemplary printer in accordance with this invention includes a support structure that has a long axis that spans the width of the substrate, and a plurality of print heads are disposed in an array along the long axis of the support structure so that the inkjet nozzles deposit a fluid on the substrate at the native resolution across the entire width of the substrate without scanning across the width of the substrate. The print head array may be rotated about a pivot point on the support structure to deposit a fluid on the substrate at any resolution greater than the native resolution. A variation of this embodiment includes multiple print head arrays disposed on the support structure, in which each print head array may be independently rotated about a respective pivot point on the support structure to deposit a fluid on the substrate at any resolution.

BRIEF DESCRIPTION OF THE DRAWINGS

Features of the present invention can be more clearly understood from the following detailed description considered in conjunction with the following drawings, in which the same reference numerals denote the same elements throughout, and in which.

DETAILED DESCRIPTION

Figure 1:
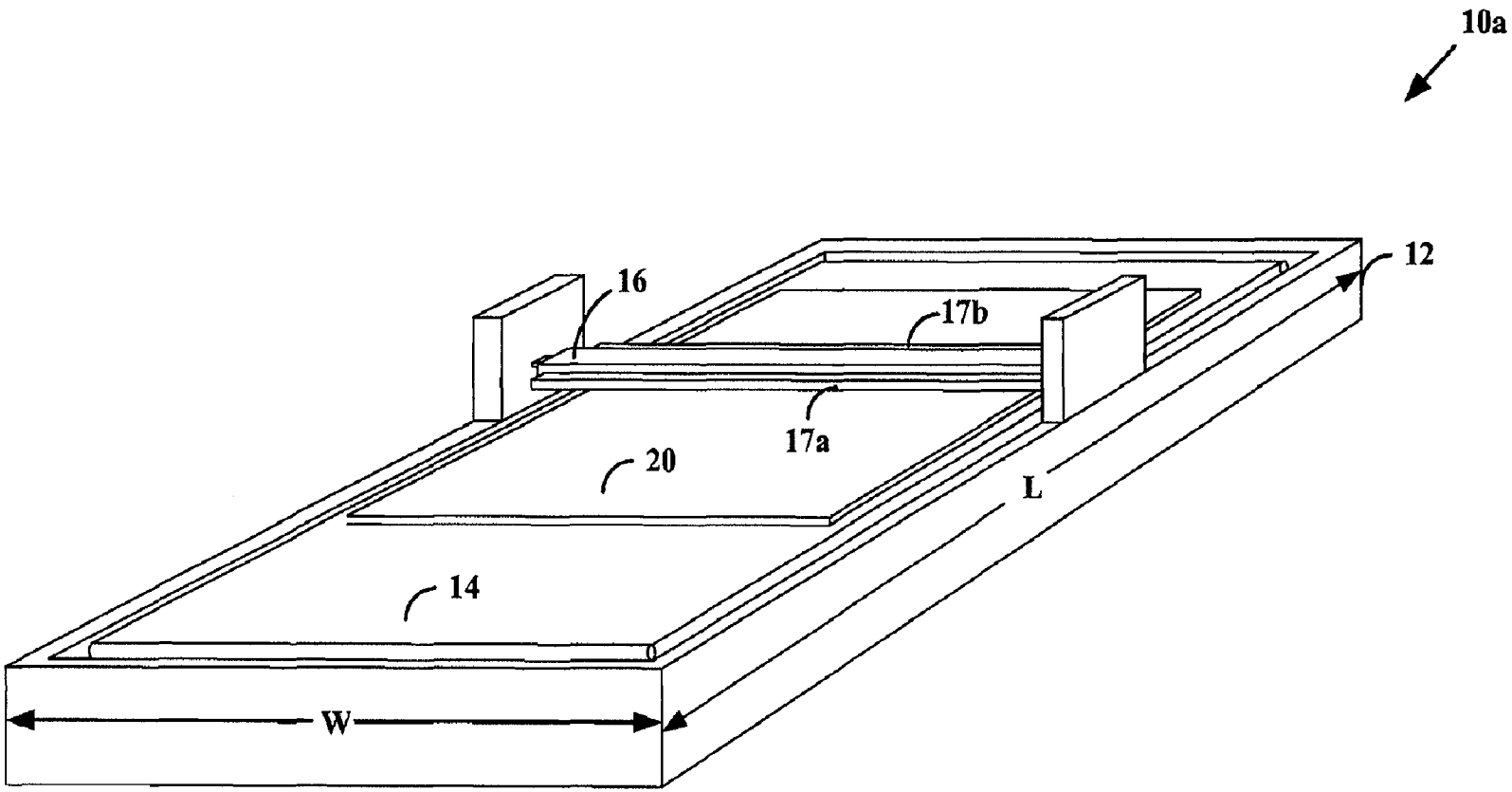
FIG. 1 is a perspective view of an exemplary printer in accordance with this invention.

Referring to FIGS. 1-3, a first exemplary embodiment of a printer in accordance with this invention is described. Printer 10*a* includes base 12, conveyor 14 and support structure 16. Printer 10*a* has a width W aligned substantially parallel to an x-axis, and a length L aligned substantially parallel to a y-axis. Support structure 16 may be a rigid elongate structure that spans the width W of printer 12, and that is used to support one or more arrays 34 of ink jet print heads 24. Support structure 16 has an origin 18, and a long axis that is parallel to the x-axis. Conveyor 14 has an end 22 that is aligned with the y-axis. Printer 10*a* also may include one or more curing stations 17 coupled to support structure 16 and/or print head arrays 34.

In particular, support structure 16 may include curing stations 17*a* and 17*b* attached to first and second sides, respectively, of support structure 16 to cure or dry fluids deposited by print heads 24 on substrate 20 during printing. Curing stations 17 may include ultraviolet ("UV") lamp systems, "cold UV" lamp systems, UV light emitting diode ("UV-LED") lamp systems, infrared heat systems, electron-beam ("e-beam") curing systems, hot air convection systems or other similar systems for curing or heating fluids.

Figure 2A:
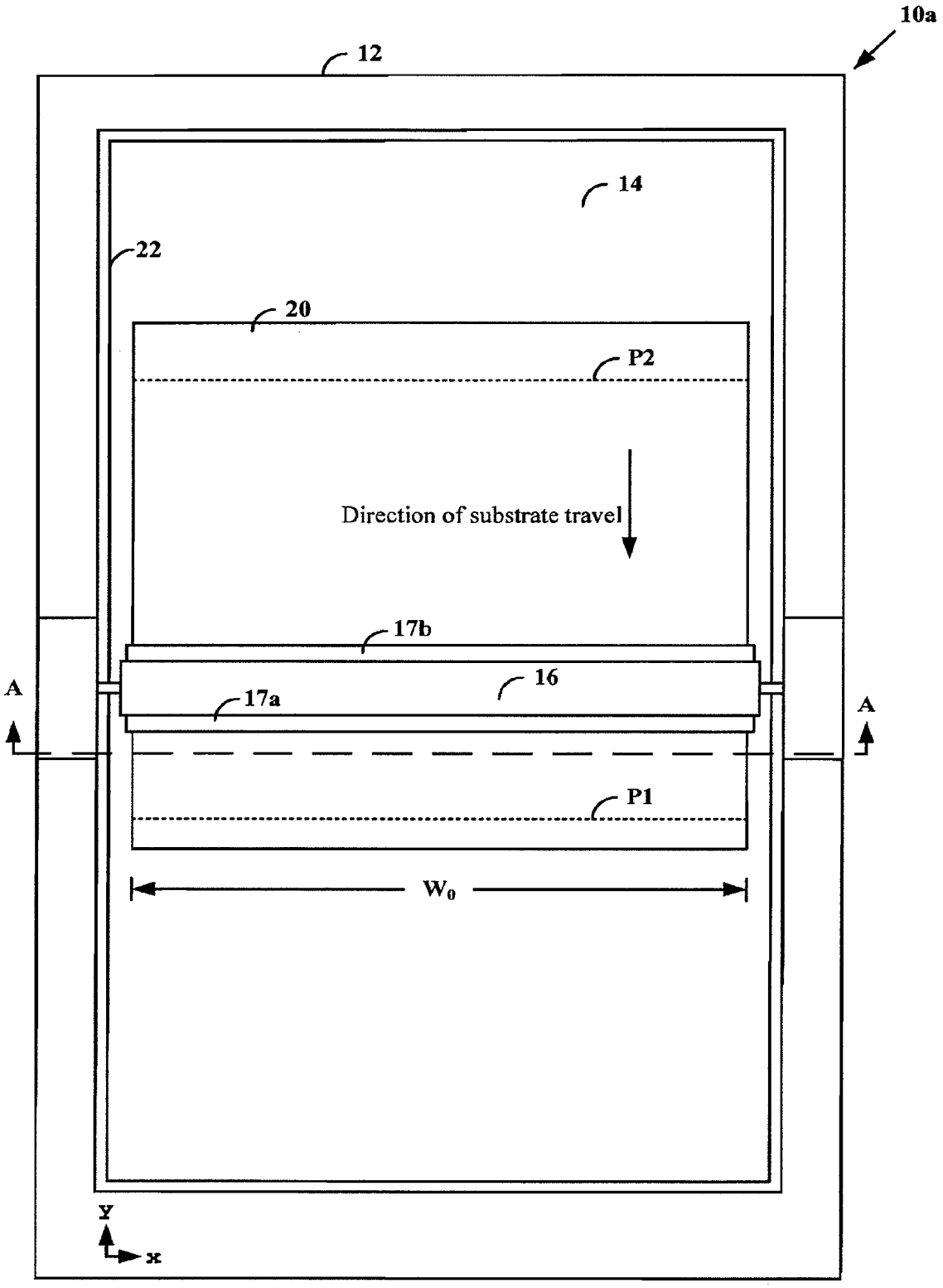
FIGS. 2A-2B are top plan views of the exemplary printer of FIG. 1.
Figure 2B:
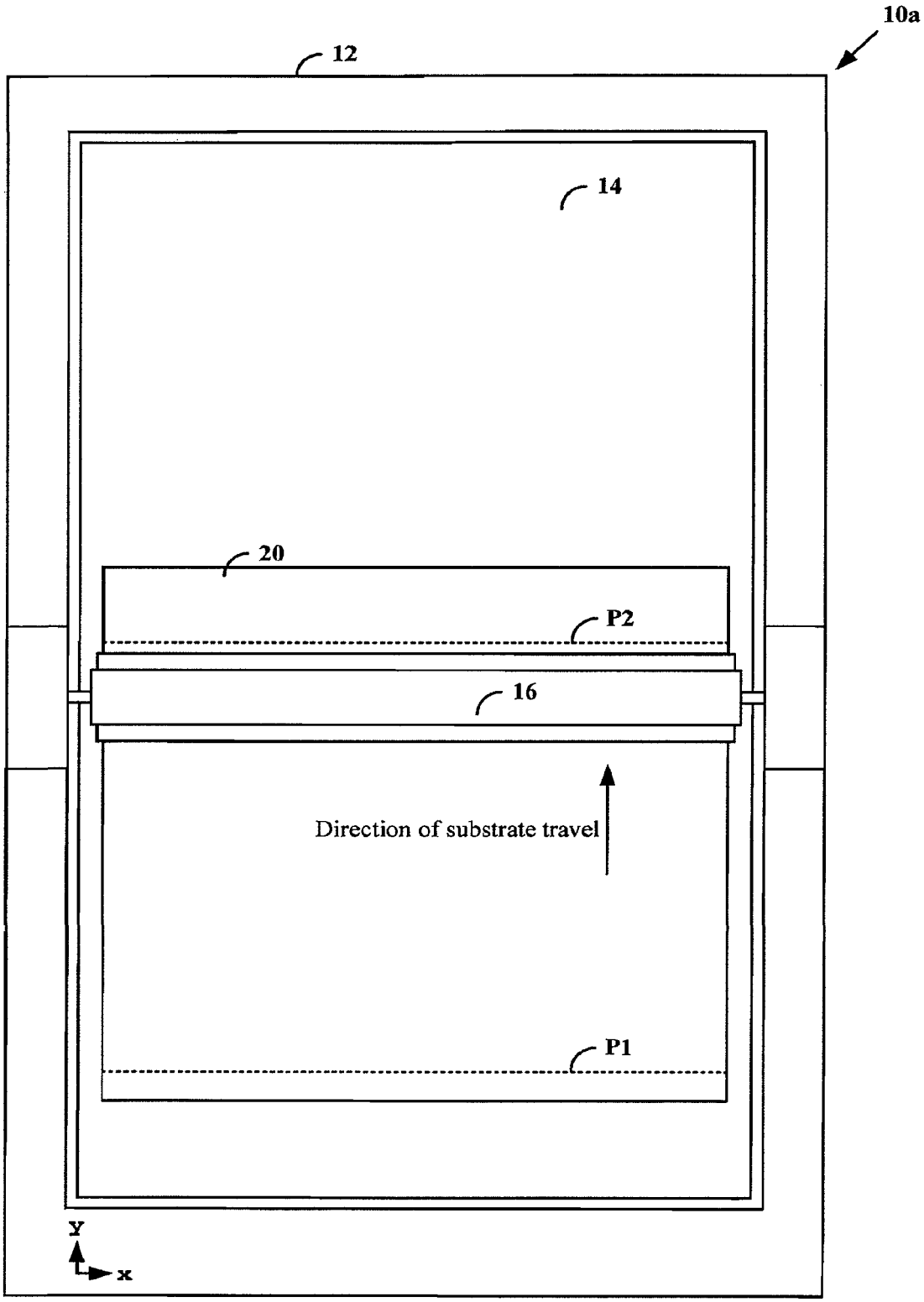

A substrate 20 is disposed on conveyor 14, which is adapted to move in either direction along the y-axis. In particular, conveyor 14 is adapted to move substrate 20 under support structure 16 as ink jet print heads 24 deposit fluids on the substrate. Thus, as shown in FIG. 2A, during a first pass, conveyor 14 may move in a first direction so that print heads 24 deposit fluids across the width of substrate 20 from a first position P1 to a second position P2 on substrate 20. As shown in FIG. 2B, during a second pass, conveyor 14 may move in a second direction so that print heads 24 deposit fluids across the width of substrate 20 from second position P2 to first position P1 on substrate 20. Positions P1 and P2 may be any positions along the length of substrate 20.

While moving along the y-axis, conveyor 14 maintains substrate 20 at a fixed location along the x-axis. Thus, conveyor 14 may be a flexible "endless belt" disposed around a rigid vacuum table, a moveable vacuum table or other similar device for controlling the x- and y-axis locations of substrate 20. Substrate 20 has a width $W_0$, and may be a metal, glass, wood, plastic, paper or other similar substrate or combination thereof.

Figure 3A:
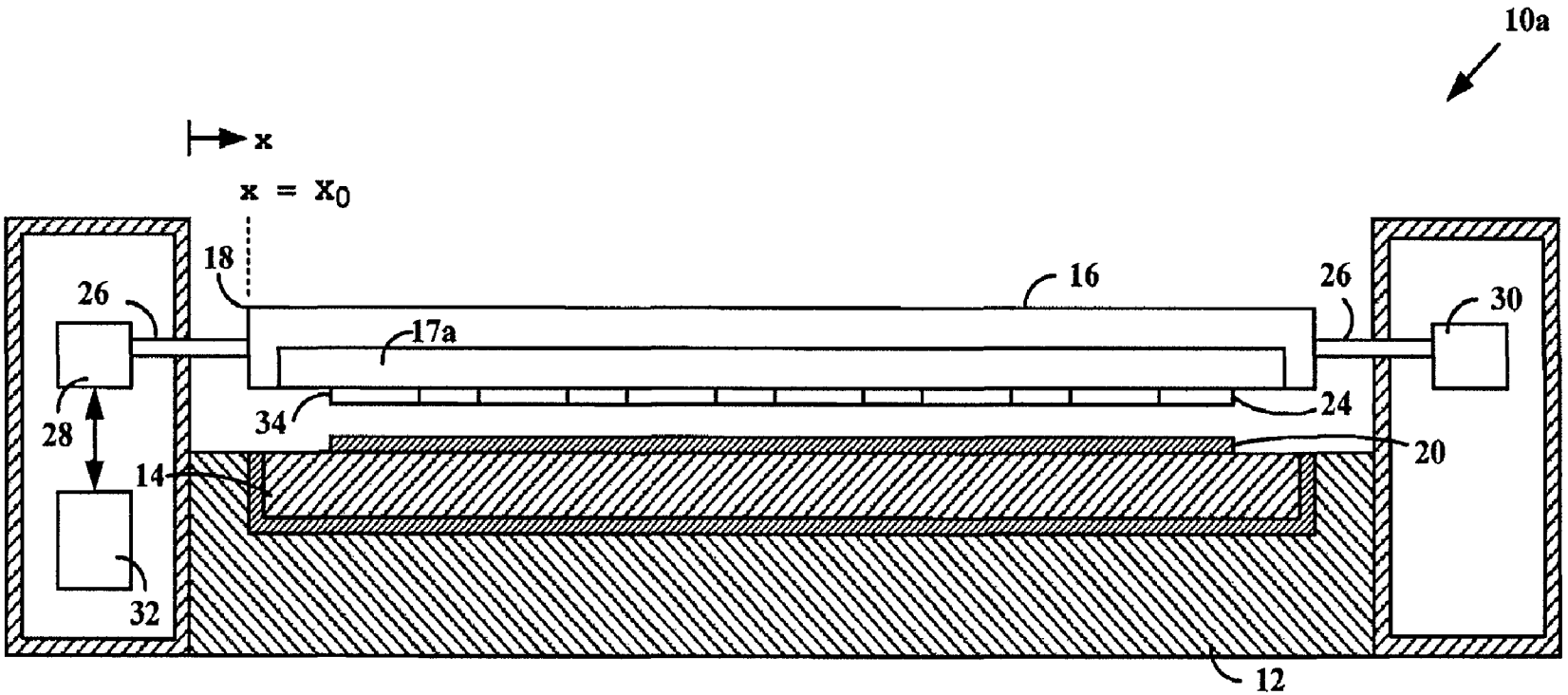
FIG. 3A-3C are cross-sectional views of the printer of FIG. 2A along the line A-A in the direction of the arrows.
Figure 3B:
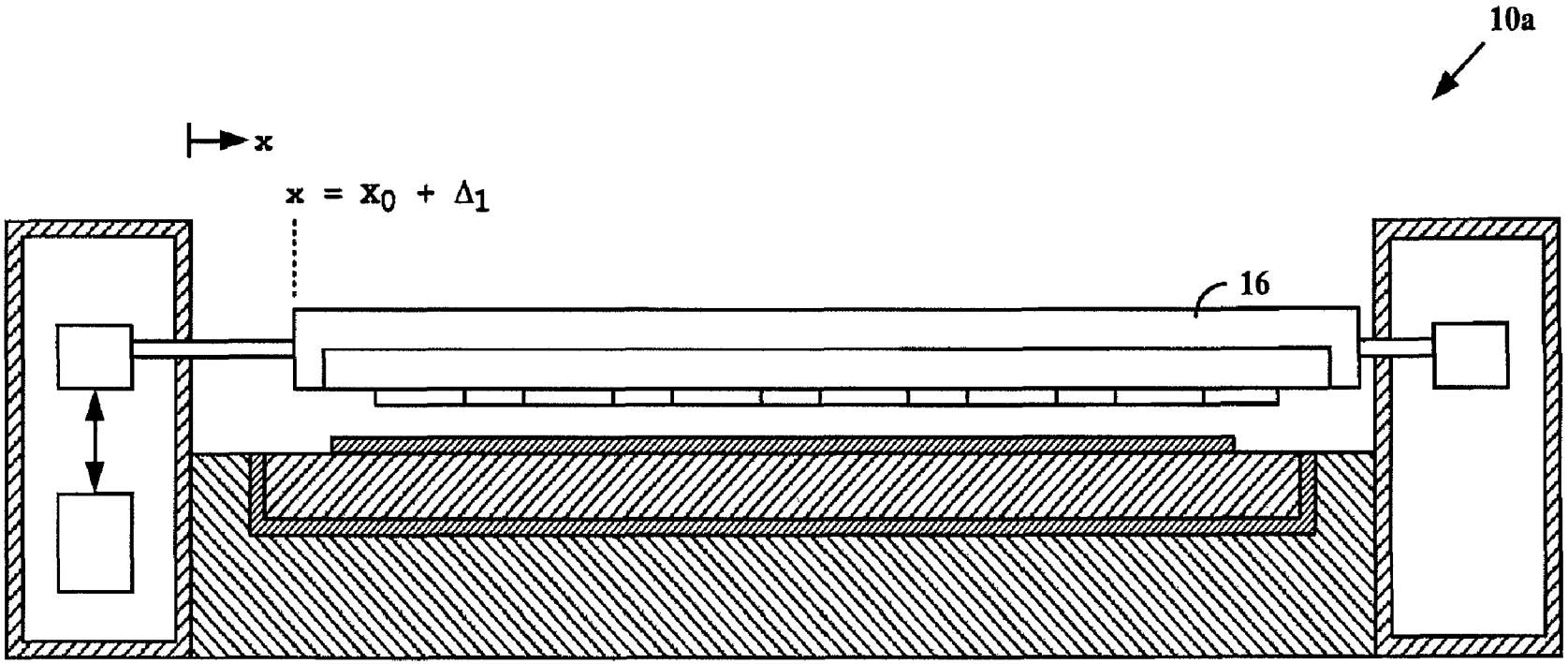
Figure 3C:
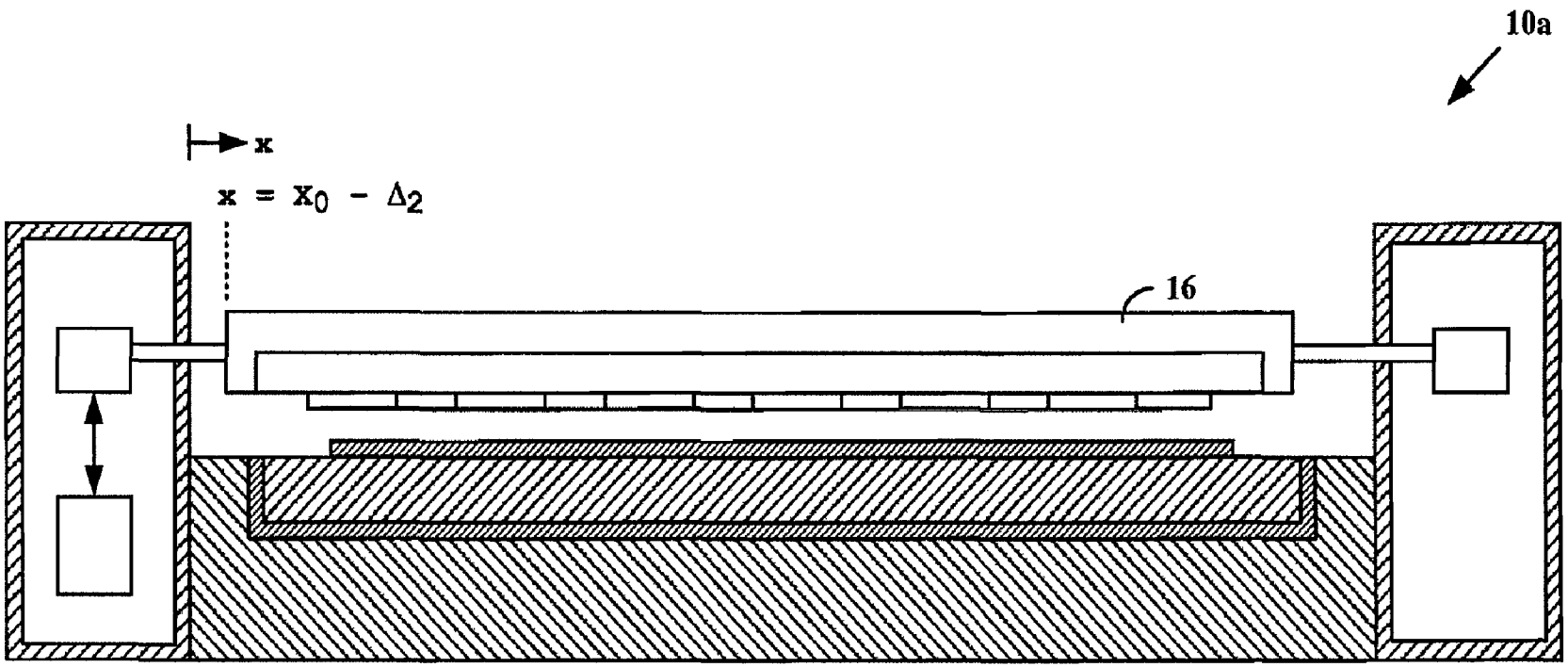

Support structure 16 is disposed above substrate 20, and is adapted to control the x-axis location of print heads 24. In particular, as shown in FIG. 3A, support structure 16 may include arms 26 that are coupled to an actuator 28 and position detector 30. Actuator 28 may be a linear actuator or other similar device that may be used to provide linear motion to support structure 16. Position detector 30 may be a linear encoder or other similar device that may be used to accurately determine the x-axis location of support structure 16. A controller 32 may be coupled to actuator 28 and position detector 30 to precisely control the x-axis location of support structure 16. For example, controller 32 may direct actuator 28 to locate origin 18 of support structure 16 at a position $x=X_0$. As illustrated in FIGS. 3B and 3C, controller 32 also may direct actuator 28 to move support structure 16 so that origin 18 is located at $x=X_0+\Delta_1$ or $x=X_0-\Delta_2$, respectively. $\Delta_1$ and $\Delta_2$ may be the same distance or may be different distances.

Figure 4:
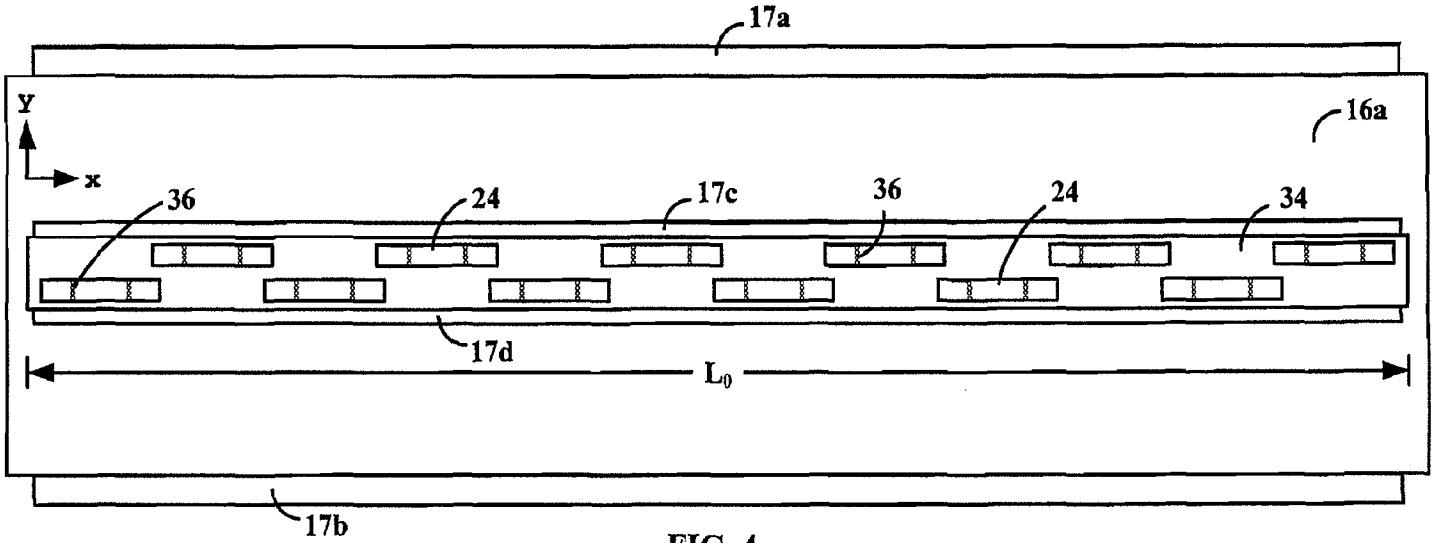
FIG. 4 is a bottom plan view of the support structure of FIG. 3A.
Figure 5:
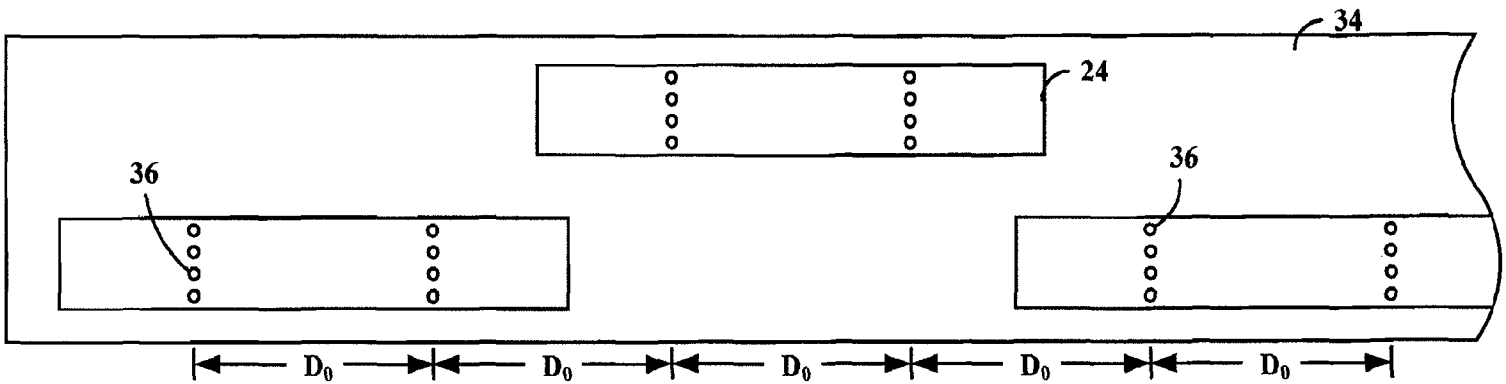
FIG. 5 is an enlarged view of a portion of the support structure of FIG. 4.

Referring now to FIGS. 4 and 5, an exemplary embodiment of support structure 16 is described. Support structure 16*a* includes an array 34 of print heads 24, each of which includes inkjet nozzles 36 that may be individually controlled to eject a fluid onto substrate 20. Fluids may be delivered to print heads 24 from a fluid reservoir system (not shown) via conventional tubing systems, via channels in support structure 16*a* that couple the print heads to the fluid reservoir system, or by other similar systems. Exemplary fluids that may be ejected by inkjet nozzles 36 include colored inks, such as cyan, magenta, yellow or black ("CMYK") inks, as are commonly used in the printing industry. Colored inks also may include light cyan, light magenta, light yellow, light black, red, blue, green, orange, white, gray, spot colors, and other similar colored inks. The inks may be solvent-based inks, dye sublimation inks, cationic inks, UV curable inks, e-beam curable inks, or other similar inks. In addition, inkjet nozzles 36 also may be used to eject fluids other than colored inks, such as clear coat finishes, UV protective finishes, and other similar fluids.

Print head array 34 may include curing stations 17*c* and 17*d* attached to first and second sides, respectively, of print head array 34 to cure or dry fluids deposited by print heads 24 on substrate 20 during printing. Curing stations 17*c* and 17*d* may include UV lamp systems, cold UV lamp systems, UV-LED lamp systems, infrared heat sources, e-beam lamp systems, hot air convection systems or other similar systems for curing or drying fluids.

Array 34 in FIG. 4 includes twelve print heads 24, each of which includes eight inkjet nozzles 36. Persons of ordinary skill in the art will understand that print head arrays 34 in accordance with this invention may include more or less than twelve print heads 24, and each print head 24 may include more or less than eight inkjet nozzles 36. Inkjet nozzles 36 are spaced apart along the long axis of the print head 24 by a dot pitch $D_0$. The resolution of each print head 24, referred to as the native resolution $R_0$, equals the inverse of the dot pitch (i.e., $1/D_0$). The native resolution is typically specified in dots per unit length, such as 37.5 dots per inch ("DPI").

Print heads 24 are disposed on array 34 such that the long axis of each print head 24 is aligned in parallel with the long axis of the array and with the long axis of support structure 16. Further, print heads 24 are staggered in the y-direction along the length $L_0$ of print head array 34 so that the print head array has a continuous resolution $R_0$ along the entire length $L_0$. In this regard, if the length $L_0$ of print head array 34 is substantially equal to the width $W_0$ of substrate 20, print head array 34 may be used to print across the entire width $W_0$ of substrate 20 at native resolution $R_0$ without scanning across width $W_0$ of substrate 20. Thus, in a single pass, printer 10*a* may print an image on substrate 20 at a continuous resolution $R_0$ across the entire width $W_0$ of substrate 20 without scanning across width $W_0$ of substrate 20.

In addition, printer 10*a* may be used to print an image across the entire width of substrate 20 at resolutions greater than native resolution $R_0$ without scanning across width $W_0$ of substrate 20. In particular, referring to FIGS. 2 and 3, during a first pass, controller 32 positions origin 18 of support structure 16 at a first x-axis position (e.g., $x=X_0$), and print head array 34 then prints a first image on substrate 20 as conveyor 14 moves substrate 20 in a first direction from P1 to P2. During a second pass, controller 30 positions origin 18 of support structure 16 at a second x-axis position (e.g., $x=X_0+\Delta_1$), and print head array 34 then prints a second image on substrate 20 as conveyor 14 moves substrate 20 in a second direction from P2 to P1. If $\Delta_1$ is a fraction of dot pitch $D_0$, this technique may be used to print an image across the entire width of substrate 20 at a composite resolution that is greater than the native resolution $R_0$. For example, if $\Delta_1=D_0/2$, printer 10*a* prints the image across the entire width of substrate 20 at a composite resolution of $2\times R_0$. Further, if this process is repeated, and $\Delta_1$ is further decreased, printer 10*a* may be used to print at even higher composite resolutions.

For example, FIGS. 6A-6D illustrate how printer 10*a* may be used to print an image across the entire width of substrate 20 at a resolution of $4\times R_0$. Persons of ordinary skill in the art will understand that the described process typically will be used with a print head array 34 that has multiple print heads 24 disposed along the length of the array, and that provides a continuous resolution $R_0$ along the entire length $L_0$. To simplify the drawings, however, only a single print head 24 is illustrated in FIGS. 6A-6D. Exemplary print head 24 includes eight ink jet nozzles 36, which include two sets of ink jet nozzles, with each set adapted to print colored inks on substrate 20. Print head 24 has a native resolution $R_0$ (e.g., 37.5 DPI).

Figure 6A:
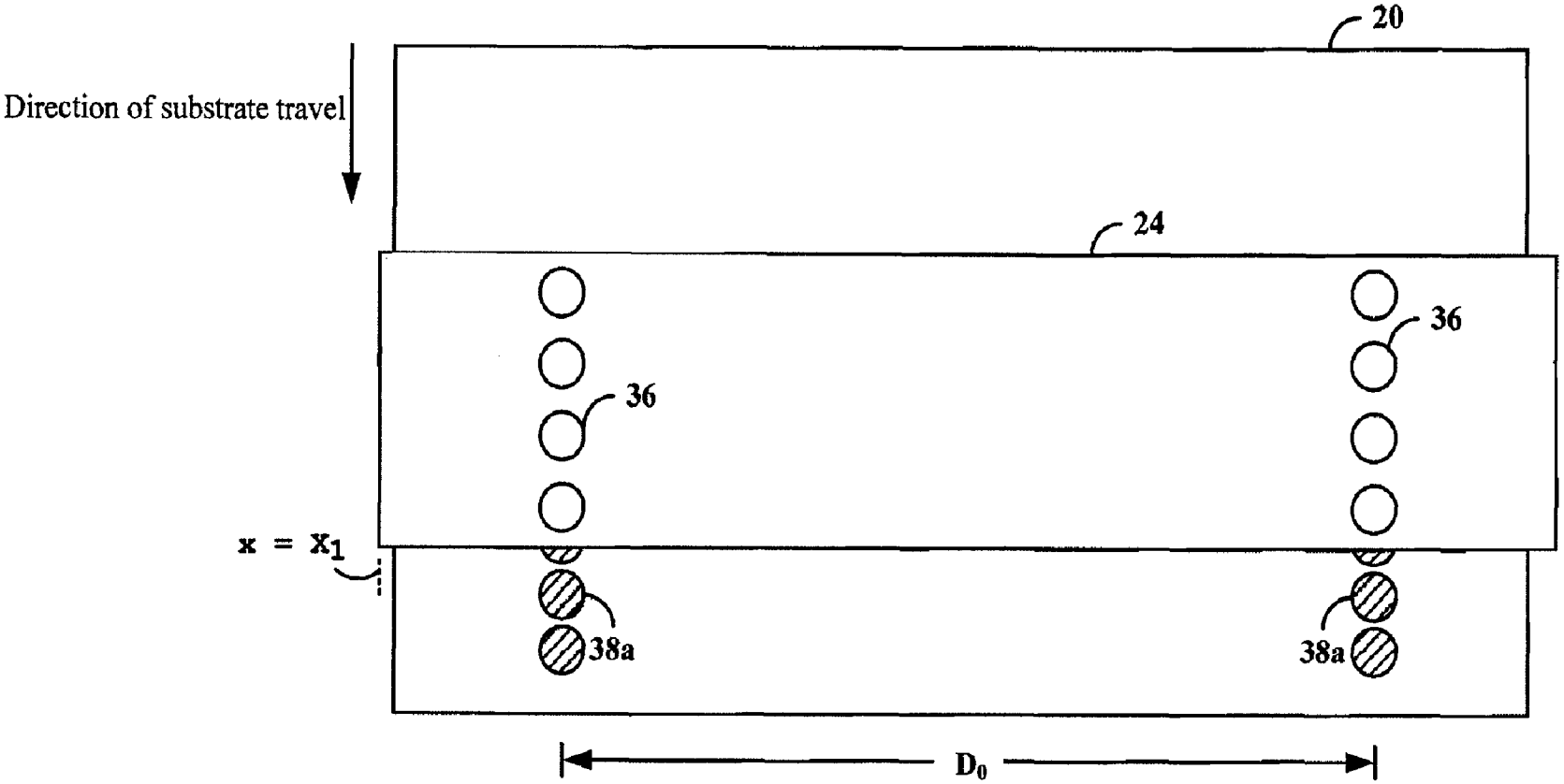
FIGS. 6A-6E are simplified views of an exemplary method of printing in accordance with this invention.
Figure 6B:
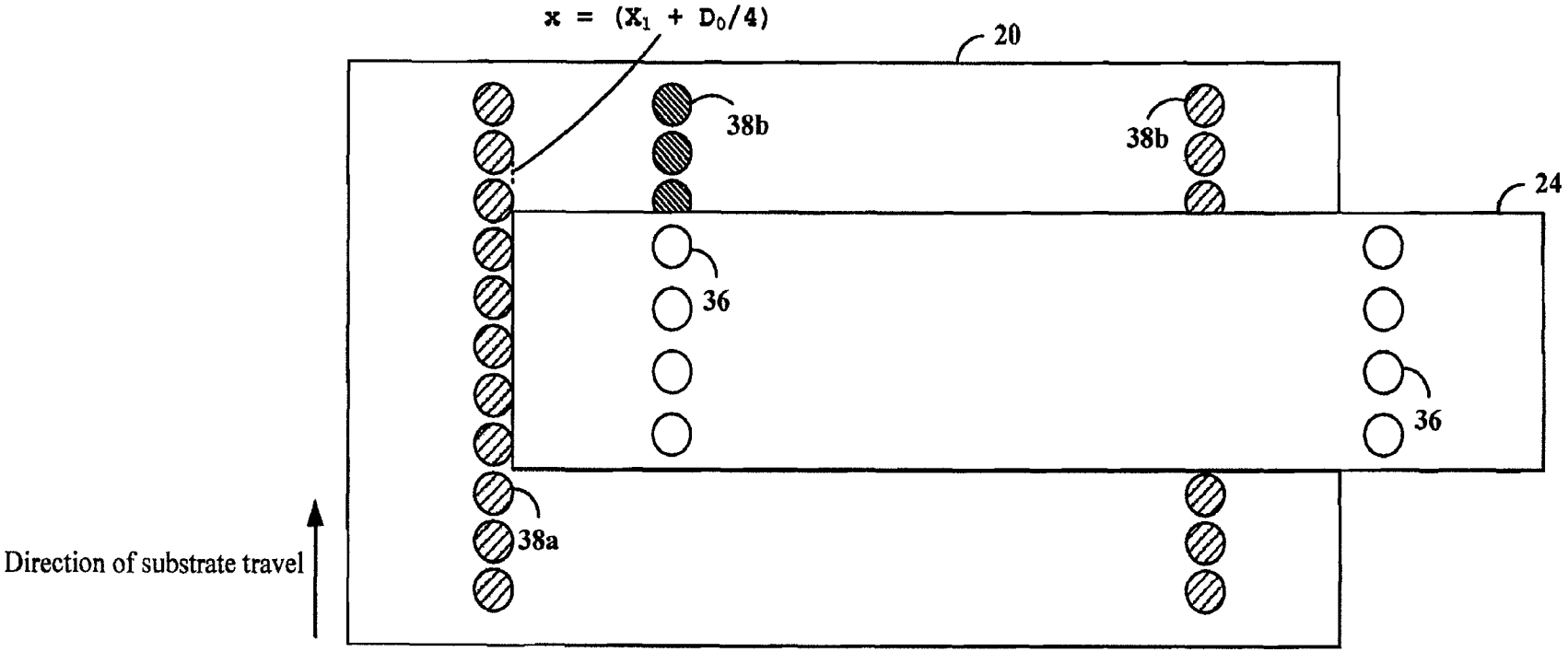
Figure 6C:
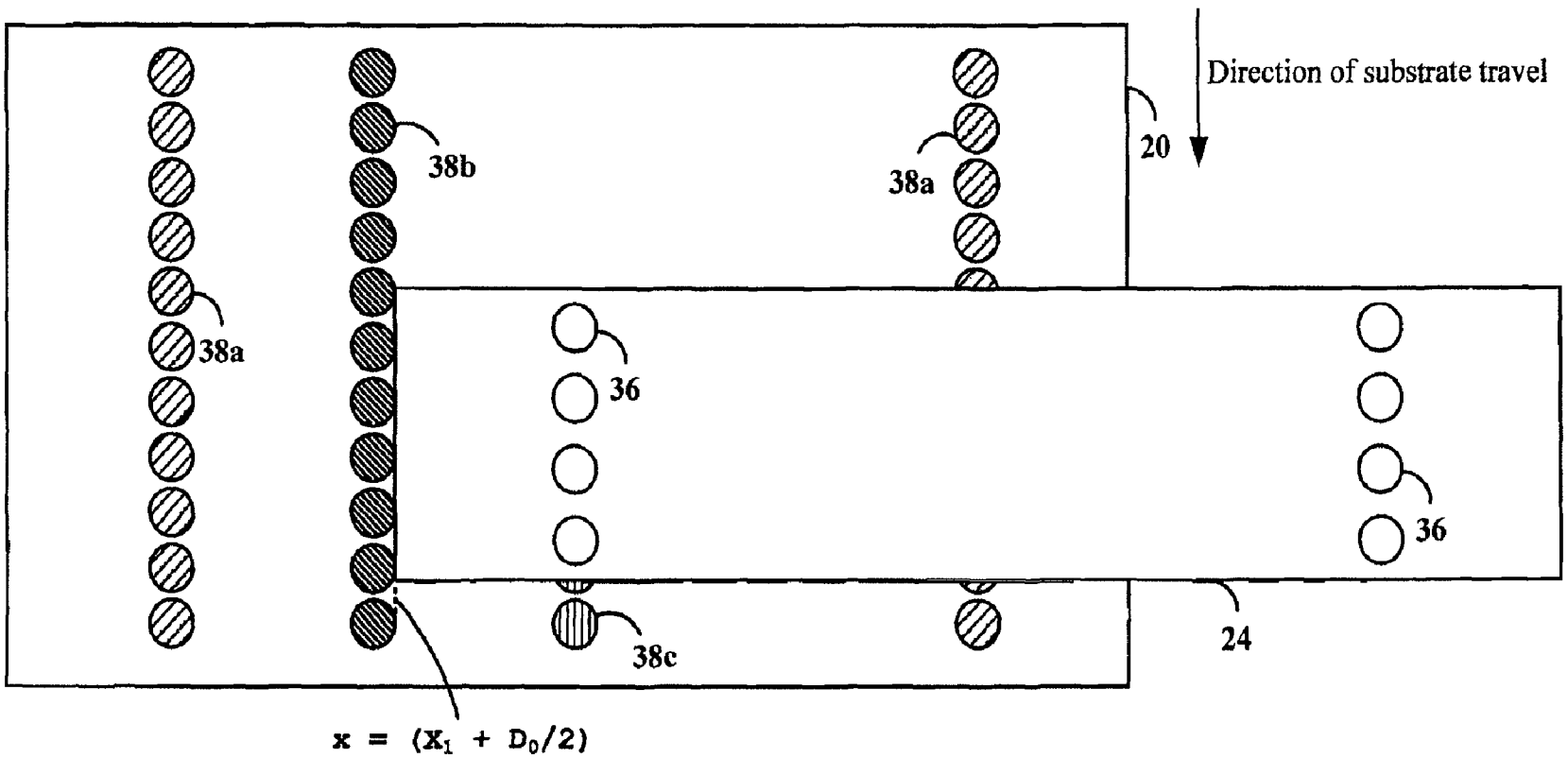
Figure 6D:
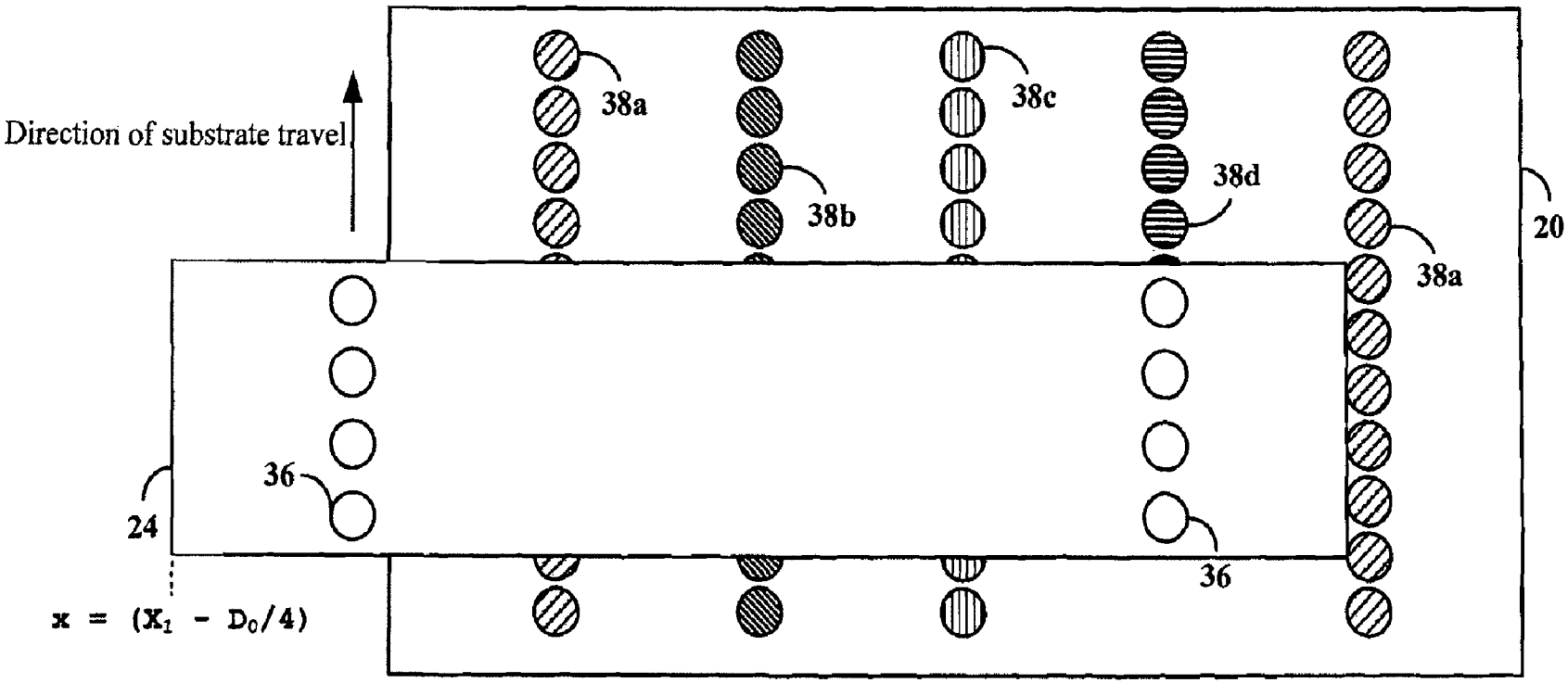

As shown in FIG. 6A, during a first pass, print head 24 is located at a first x-axis position, $x=X_1$, conveyor 14 moves substrate 20 in a first direction, and print head 24 prints a first image 38*a* on substrate 20. Next, as shown in FIG. 6B, during a second pass, print head 24 is located at a second x-axis position, $x=(X_1+D_0/4)$, conveyor 14 moves substrate 20 in a second direction, and print head 24 prints a second image 38*b* on substrate 20. Next, as shown in FIG. 6C, during a third pass, print head 24 is located at a third x-axis position, $x=(X_1+D_0/2)$, conveyor 14 moves substrate 20 in the first direction, and print head 24 prints a third image 38*c* on substrate 20. Finally, as shown in FIG. 6D, during a fourth pass, print head 24 is located at a fourth x-axis position, $x=(X_1-D_0/4)$, conveyor 14 moves substrate 20 in the second direction, and print head 24 prints a fourth image 38*d* on substrate 20. Persons of ordinary skill in the art will understand that the fourth x-axis position alternatively could be $x=(X_1+3D_0/4)$.

Figure 6E:
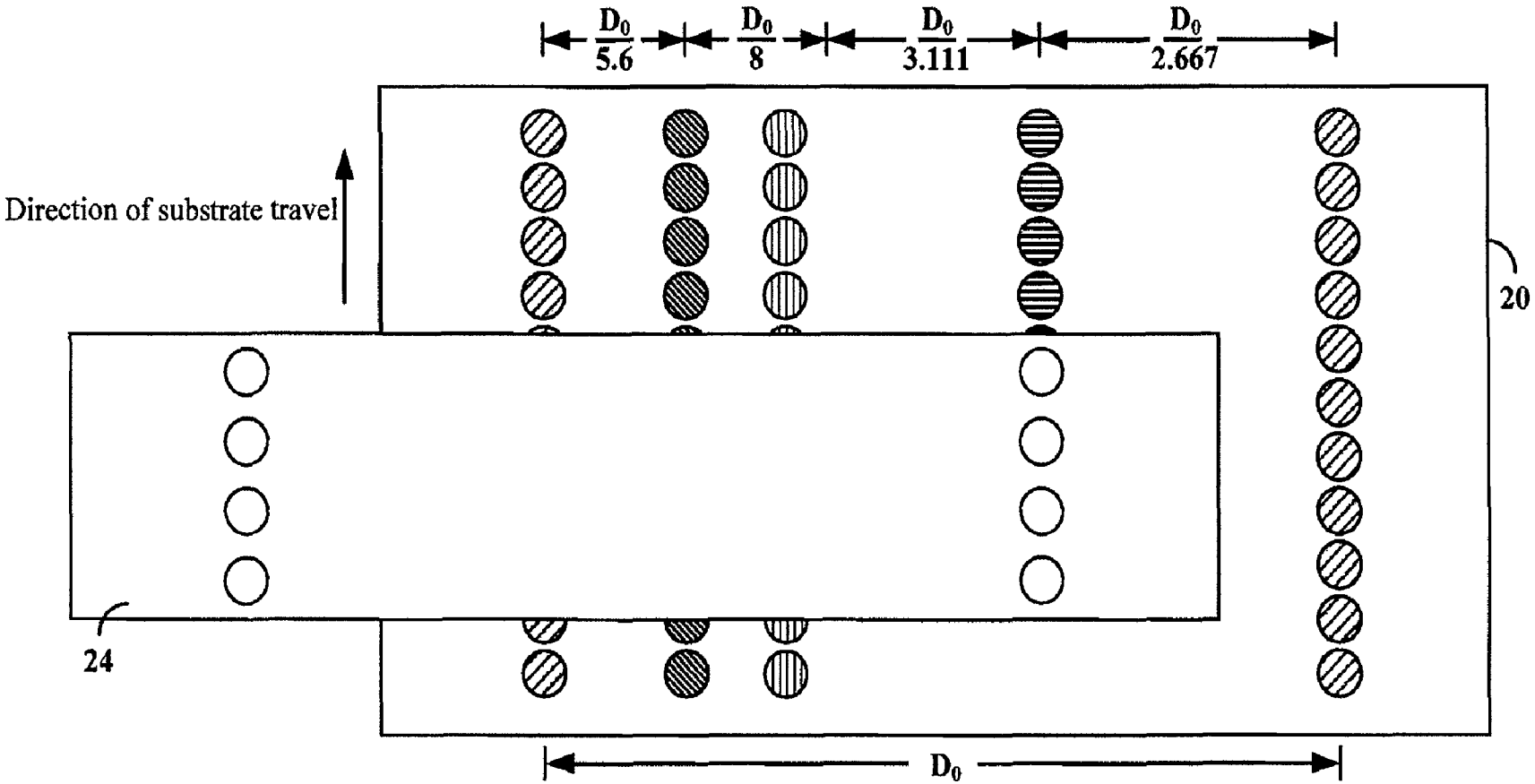

Thus, after four passes, print head 24 prints images 38*a*-38*d* across the entire width of substrate 20 at a composite resolution of $4\times R_0$ (e.g., 150 DPI). In general, therefore, to print across the entire width of substrate 20 at a composite resolution of $NR_0$, printer 10*a* prints in N passes, and shifts the x-axis position of support structure 16 (and therefore print heads 24) between each pass. The amount of each shift may be uniform or non-uniform. For example, as shown in FIGS. 6A-6D, support structure 16 is uniformly shifted by integer multiples of $D_0/N$ between each pass. Persons of ordinary skill in the art will understand that support structure 16 may be shifted by arbitrary amounts and/or non-uniformly between each pass. For example, FIG. 6E illustrates printing in four passes at a composite resolution of $4\times R_0$, but shifting support structure by $D_0/5.6$, $D_0/8$, $D_0/3.111$ and $D_0/2.667$ between each pass.

Apparatus and methods in accordance with this invention also may print across the entire width of substrate 20 at a resolution greater than native resolution $R_0$ without requiring multiple printing passes. In particular, multiple print head arrays 34 may be grouped on support structure 16, with each print head array 34 offset in the x-direction from adjacent print head arrays. For example, FIG. 7 illustrates an alternative exemplary support structure 16*b* that includes four print head arrays 34*a*-34*d* staggered in the y-direction, with each print head array 34 offset in the x-direction by $D_0/4$ from adjacent print head arrays 34.

Figure 7:
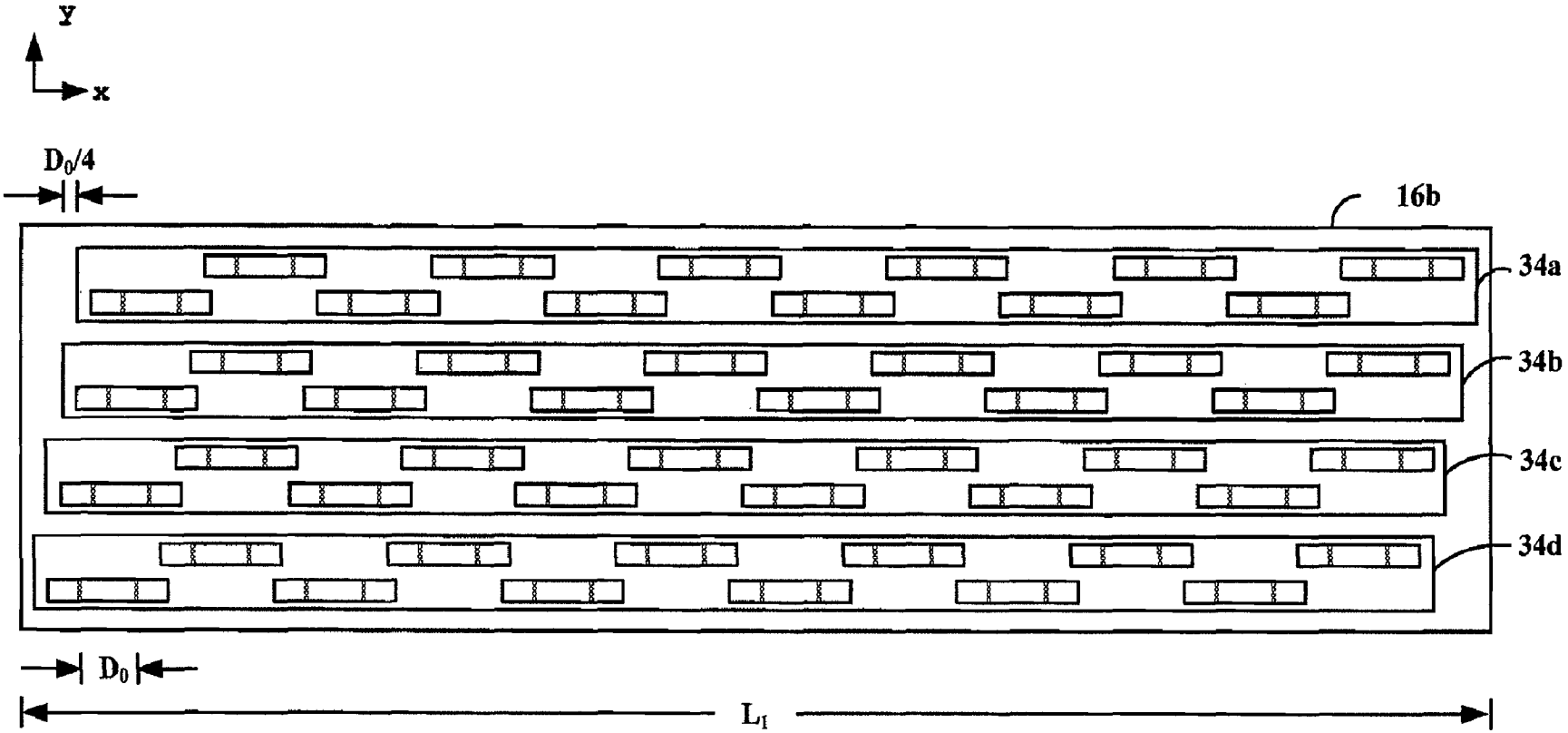
FIG. 7 is a bottom plan view of an alternative support structure in accordance with this invention.
Figure 8:
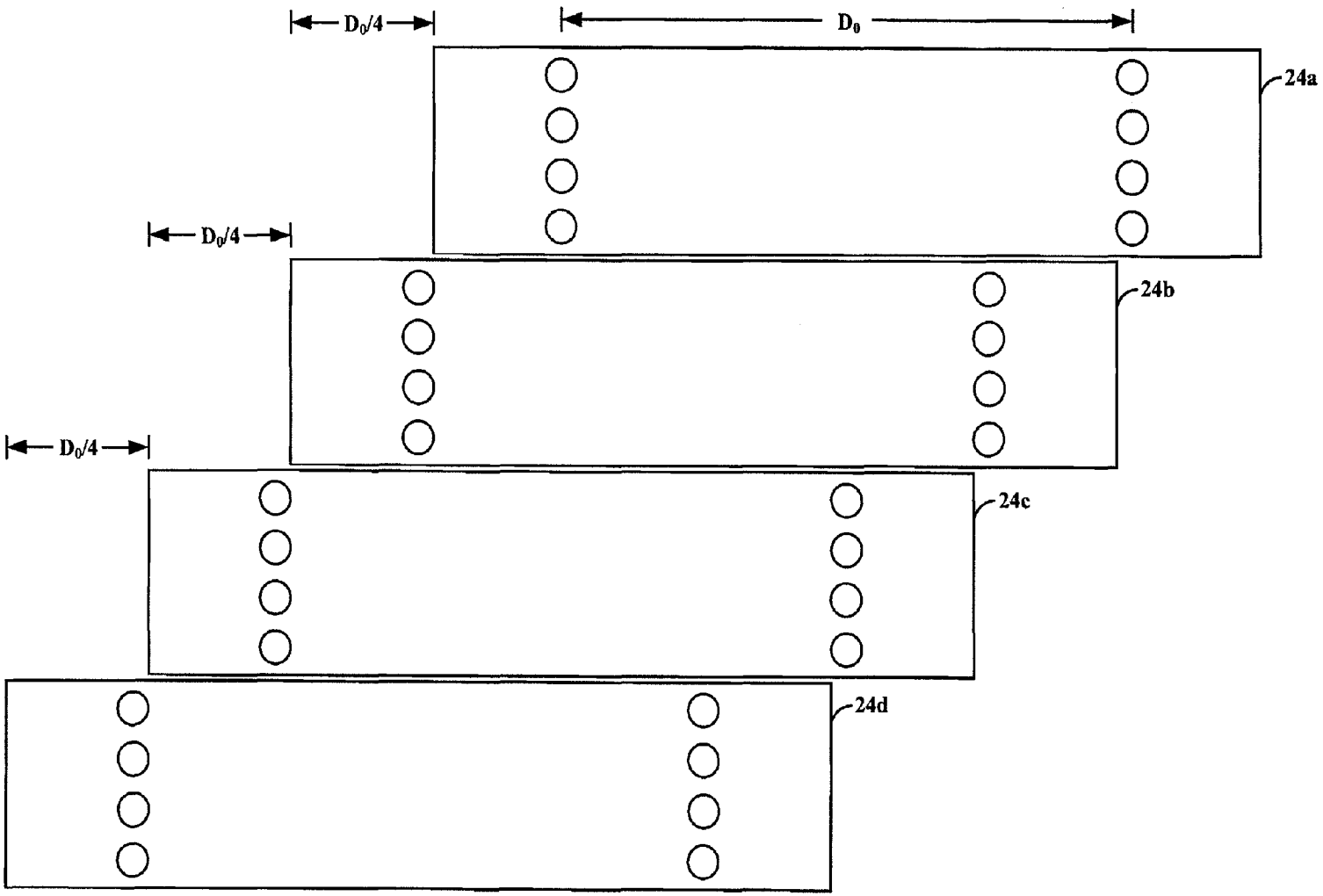
FIG. 8 is a simplified view of the print head arrays of FIG. 7.

FIG. 8 illustrates a simplified view of FIG. 7, with a single print head 24*a* 24*d* from each of print head arrays 34*a*-34*d*, respectively. In this example, each print head array 34 has a native resolution $R_0=1/D_0$, and the group of print head arrays 34*a*-34*d* provides a continuous resolution of $4\times R_0$ (e.g., 150 DPI) along the entire length $L_1$ of support structure 16*b*. Thus, if $L_1$ substantially equals width $W_0$ of substrate 20, support structure 16*b* may be used to print across the entire width $W_0$ of the substrate 20 at a composite resolution of $4\times R_0$. Persons of ordinary skill in the art will understand that more than or less than four print head arrays 34 may be grouped together on support structure 16, depending on the desired composite resolution.

Figure 9:
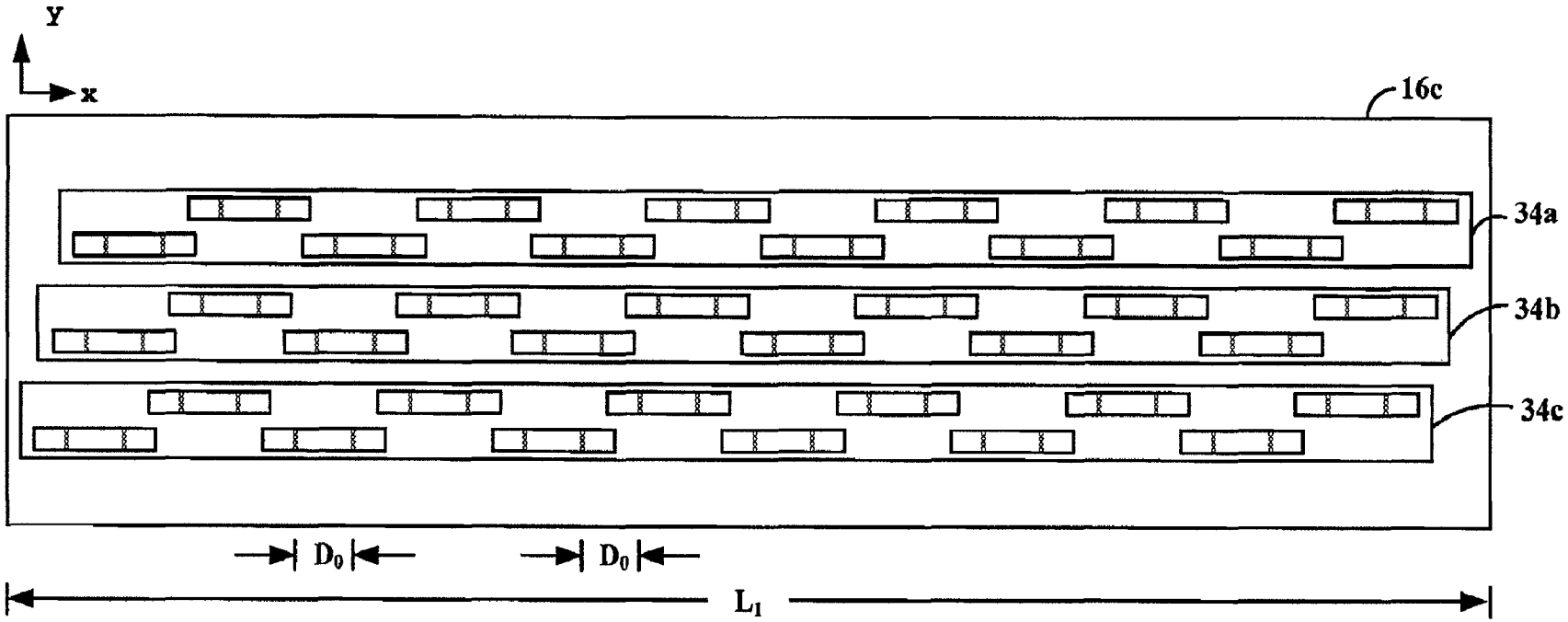
FIG. 9 is a bottom plan view of another alternative support structure in accordance with this invention.
Figure 10A:
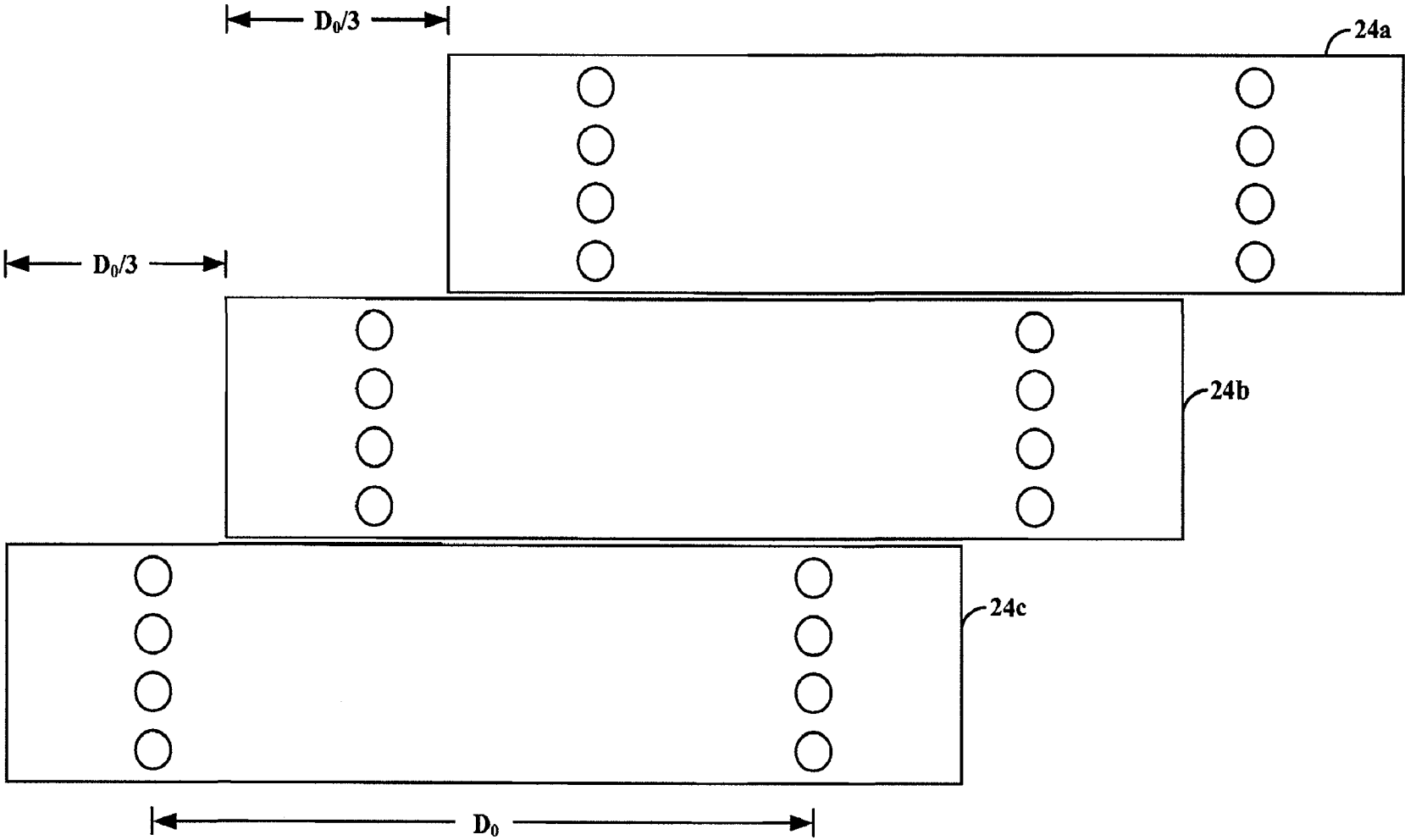
FIGS. 10A and 10B are simplified views of the print head arrays of FIG. 9.

For example, FIG. 9 illustrates an alternative exemplary support structure 16*c* that includes three print head arrays 34*a*-34*c* staggered in the y-direction, with each print head array 34 offset in the x-direction by $D_0/3$ from adjacent print head arrays 34. FIG. 10A illustrates a simplified view of FIG. 9, with a single print head 24*a*-24*c* from each of print head arrays 34*a*-34*c*, respectively. In this example, the group of print head arrays 34*a*-34*c* has a composite resolution $3\times R_0$ (e.g., 112.5 DPI) along the entire length $L_1$. Thus, support structure 16*c* may be used to print across the entire width $W_0$ of the substrate 20 at a composite resolution of $3\times R_0$.

Figure 10B:
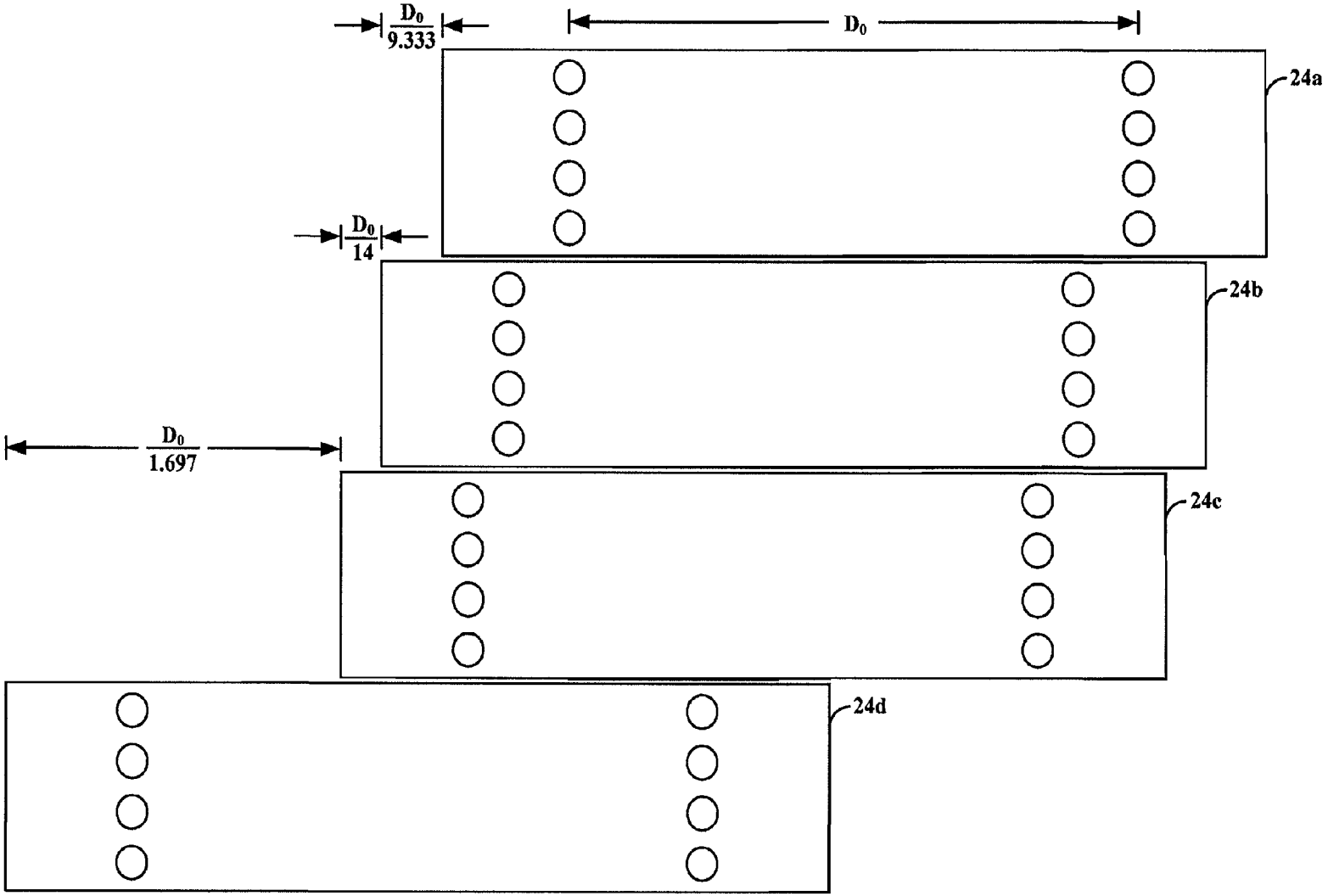

In general, therefore, to print across the entire width of substrate 20 at a composite resolution of $M\times R_0$, support structure 16 includes M print head arrays 34, with each print head array 34 offset in the x-direction from adjacent print head arrays 34 by $D_0/M$. Persons of ordinary skill in the art will understand, however, that other x-axis offset values may be used to achieve the same composite resolution, and that the x-axis offset values may be integer or non-integer fractions of $D_0$ (e.g., $D_0/1.697$, $D_0/14$, $D_0/9.333$, etc.), and may be uniform or non-uniform, such as illustrated in FIG. 10B.

The two techniques described above can be combined to further increase the resolution of printers in accordance with this invention. In particular, to print across the entire width of substrate 20 at a composite resolution of $M\times N\times R_0$, printer 10*a* includes a support structure 16 that includes M print head arrays 34, with each print head array 34 offset in the x-direction by $D_0/M$ from adjacent print head arrays. The support structure 16 may then be used to print in N passes, with an x-axis shift of support structure 16 by multiples of $1/(NR_0)$ between each pass.

For example, FIGS. 11A-11D illustrate exemplary apparatus and methods in accordance with this invention for printing an image across the entire width of substrate 20 at a resolution of $16\times R_0$ (e.g., M=N=4). In particular, support structure 16*b* of FIG. 7 may be used, with four print head arrays 34*a*-34*d* staggered in the y-direction and offset from one another in the x-direction by $D_0/4$. To simplify the drawings in FIGS. 11A-11D, each print head array 34*a*-34*d* is shown including only a single print head 24*a*-24*d*, respectively. Each exemplary print head 24*a*-24*d* includes eight ink jet nozzles 36, and has a native resolution $R_0$ (e.g., 37.5 DPI). The group of print head arrays 34*a*-34*c* print across the entire width of substrate 20 at a composite resolution $4\times R_0$ (e.g., 150 DPI).

Figure 11A:
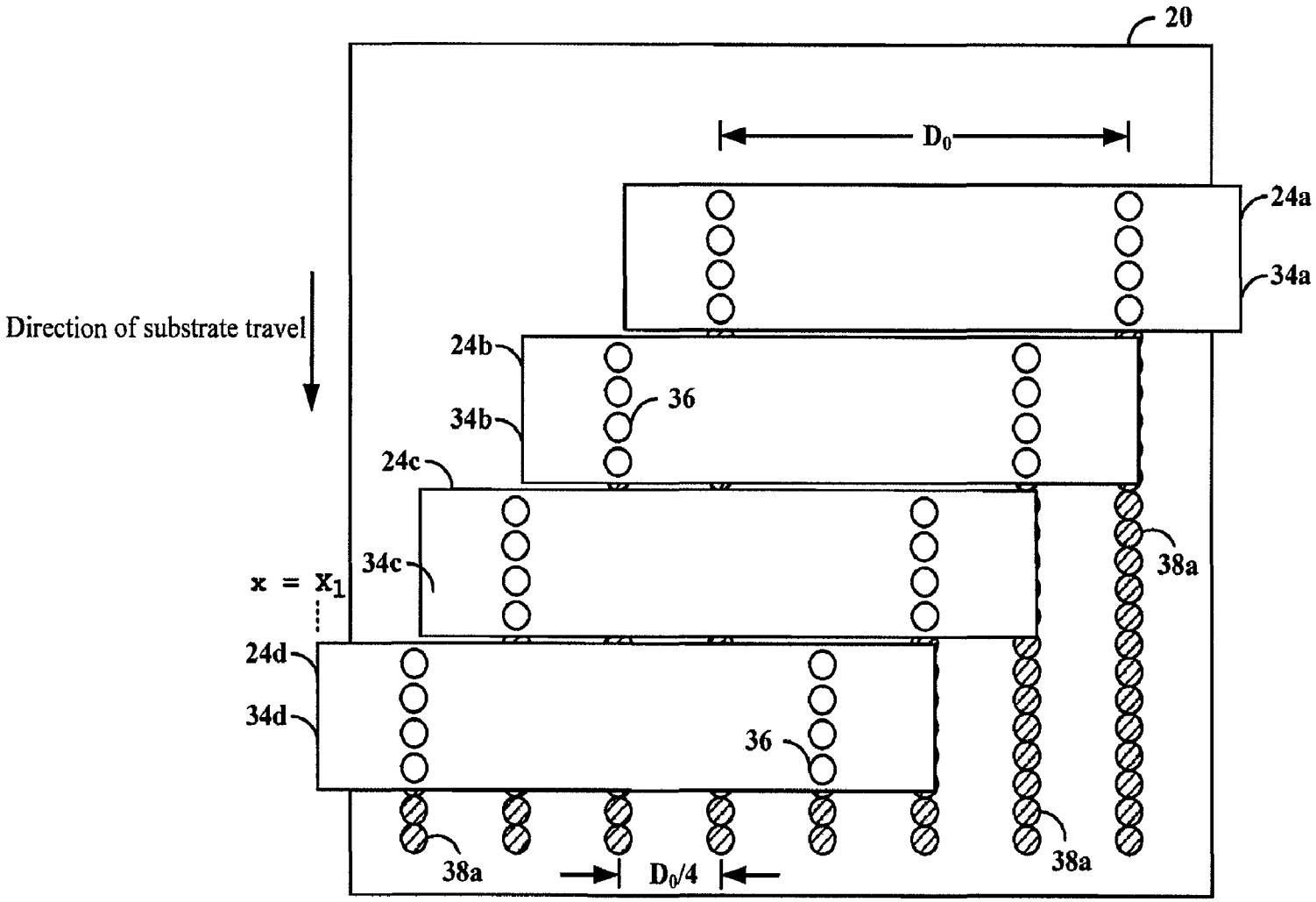
FIGS. 11A-11D are simplified views of an alternative exemplary method of printing in accordance with this invention.
Figure 11B:
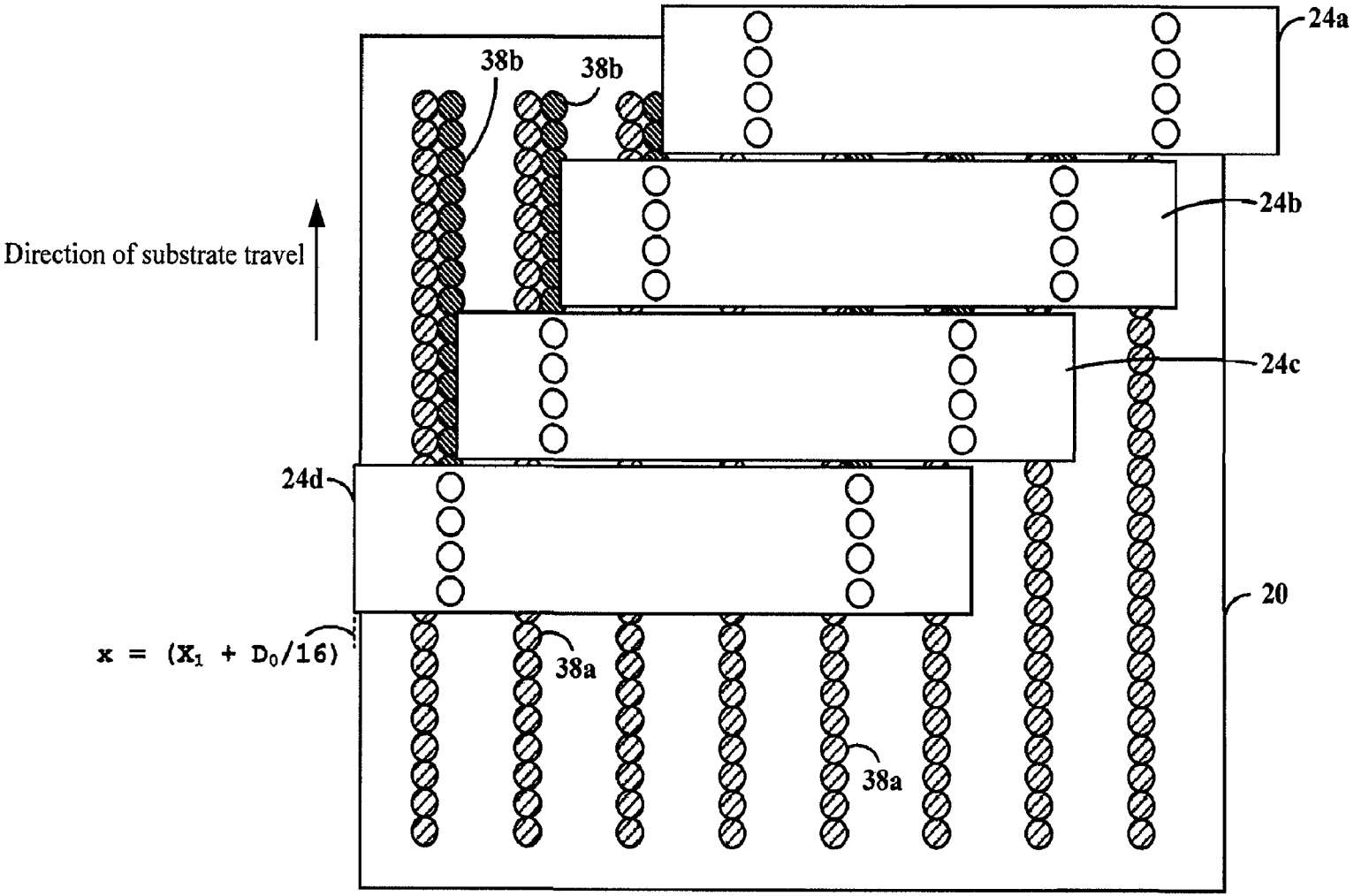
Figure 11C:
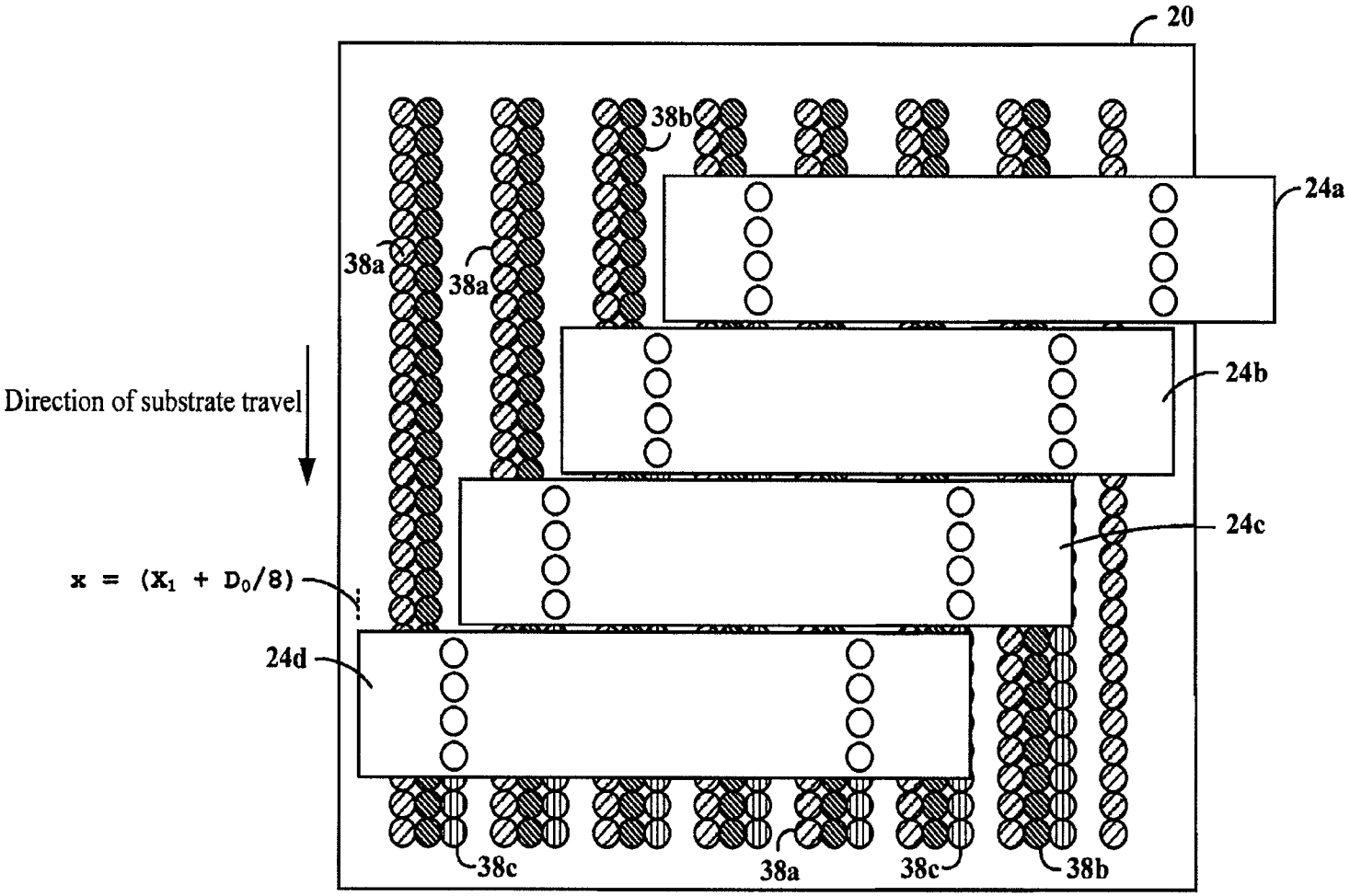
Figure 11D:
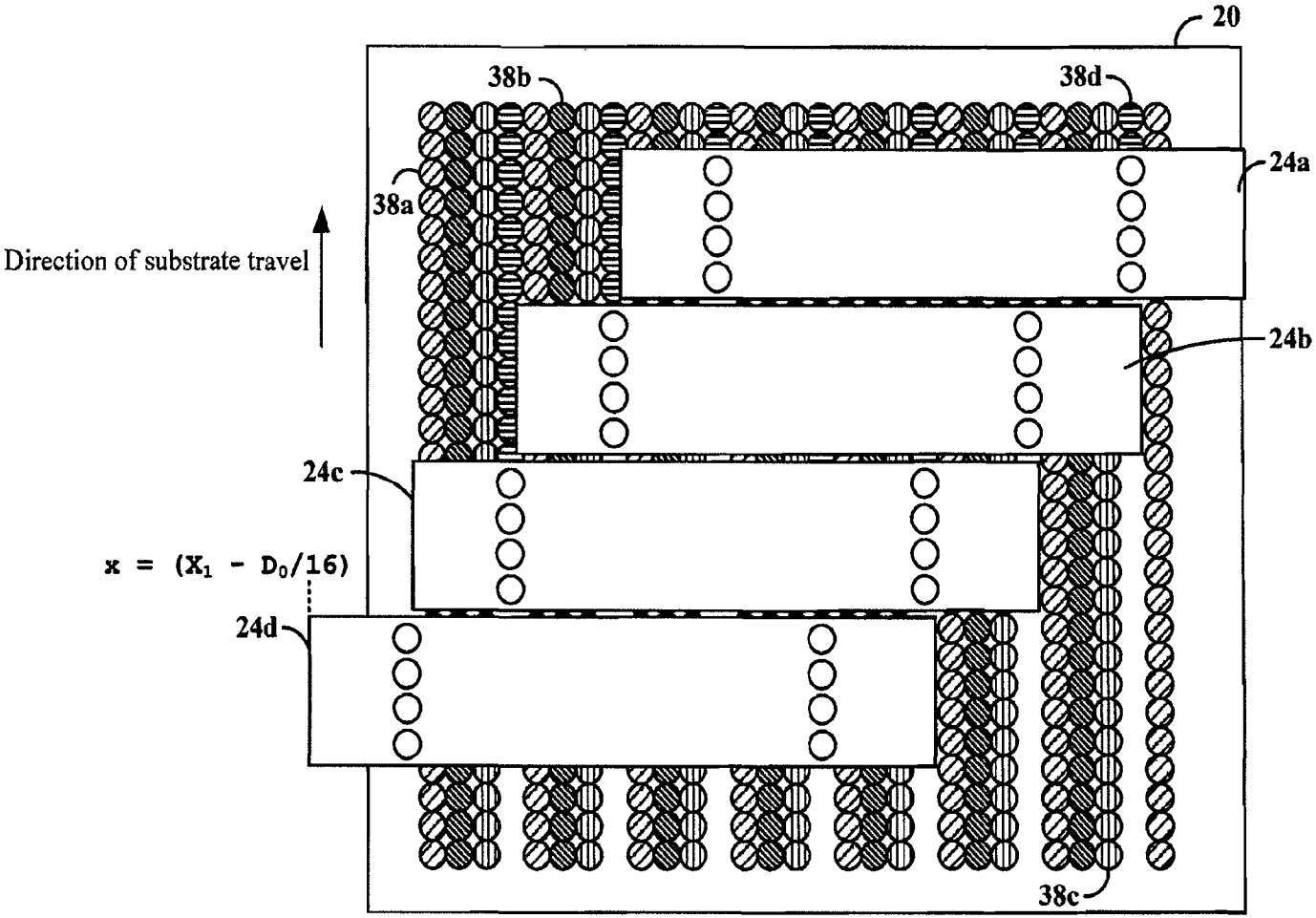

As shown in FIG. 11A, during a first pass, the group of print head arrays 34*a*-34*d* is located at a first x-axis position, $x=X_1$, substrate 20 moves in a first direction, and print heads 24*a*-24*d* print a first image 38*a* on substrate 20. Next, as shown in FIG. 11B, during a second pass, the group of print head arrays 34*a*-34*d* is located at a second x-axis position, $x=(X_1+D_0/16)$, substrate 20 moves in a second direction, and print heads 24*a*-24*d* print a second image 38*b* on substrate 20. Next, as shown in FIG. 11C, during a third pass, the group of print head arrays 34*a*-34*d* is located at a third x-axis position, $x=(X_1+D_0/8)$, substrate 20 moves in the first direction, and print heads 24*a*-24*d* print a third image 38*c* on substrate 20. Finally, as shown in FIG. 11D, during a fourth pass, the group of print head arrays 34*a*-34*d* is located at a fourth x-axis position, $x=(X_1-D_0/16)$, substrate 20 moves in the second direction, and print heads 24*a*-24*d* print a fourth image 38*d* on substrate 20. Persons of ordinary skill in the art will understand that the fourth x-axis position alternatively could be $x=(X_1+3D_0/16)$. Thus, after four passes, the group of print head arrays 34*a*-34*d* prints images 38*a*-38*d* on substrate 20 at a composite resolution of $4\times4\times R_0$ (e.g., 600 DPI) across the entire width of substrate 20.

Persons of ordinary skill in the art will understand that the sequence of printing steps may be modified from that shown in FIGS. 11A-11D. For example, image 38*a* may be printed during the first pass, image 38*c* may be printed during the second pass, image 38*d* may be printed during the third pass and image 38*b* may be printed during the fourth pass, and so on. Persons of ordinary skill in the art also will understand that print head arrays 34*a*-34*d* may be offset from one another in the x-direction by uniform or non-uniform amounts, and that the group of print head arrays 34*a*-34*d* may be shifted by arbitrary amounts and/or non-uniformly between each pass.

Figure 12A:
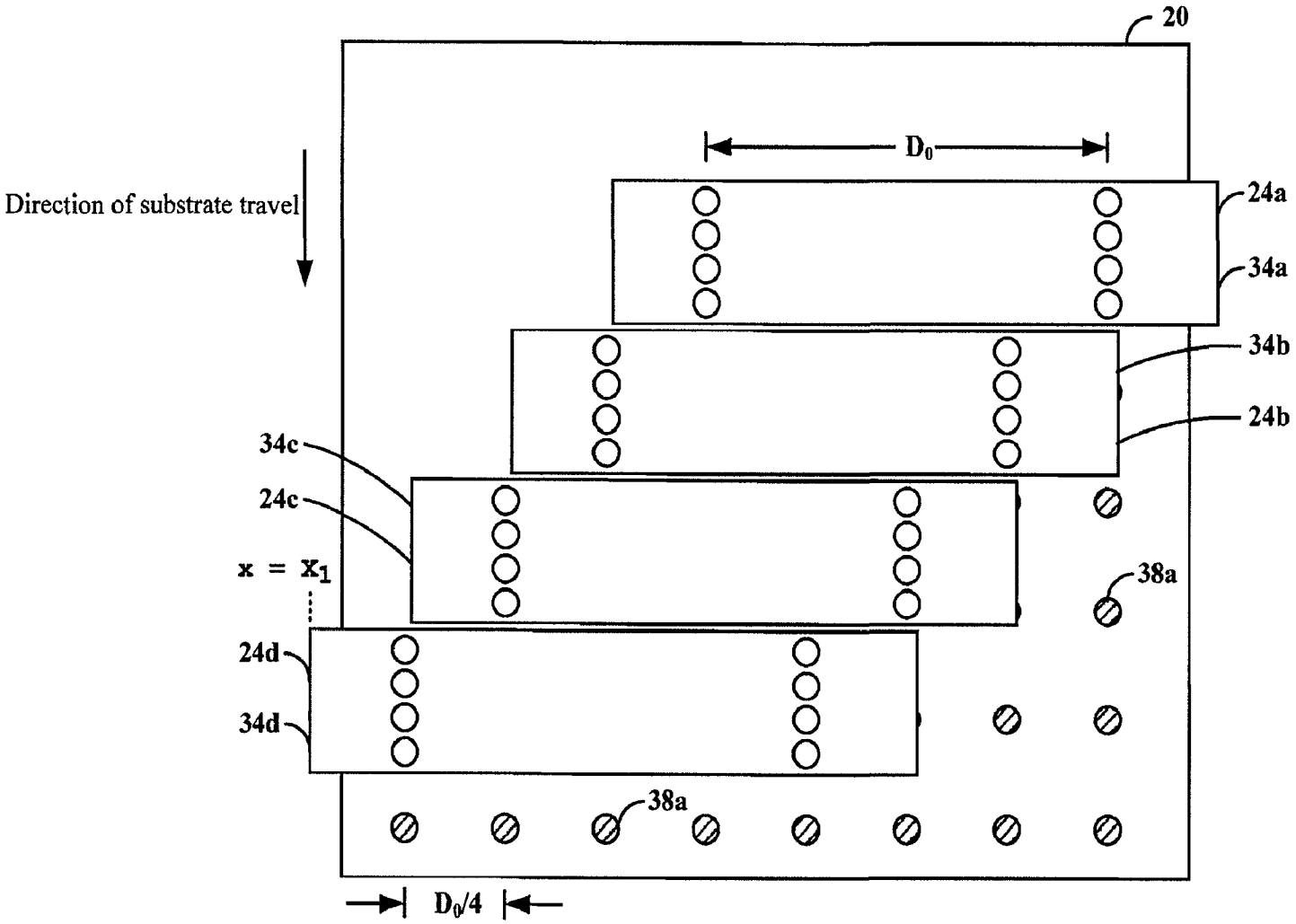
FIGS. 12A-12B are simplified views of another alternative exemplary method of printing in accordance with this invention.
Figure 12B:
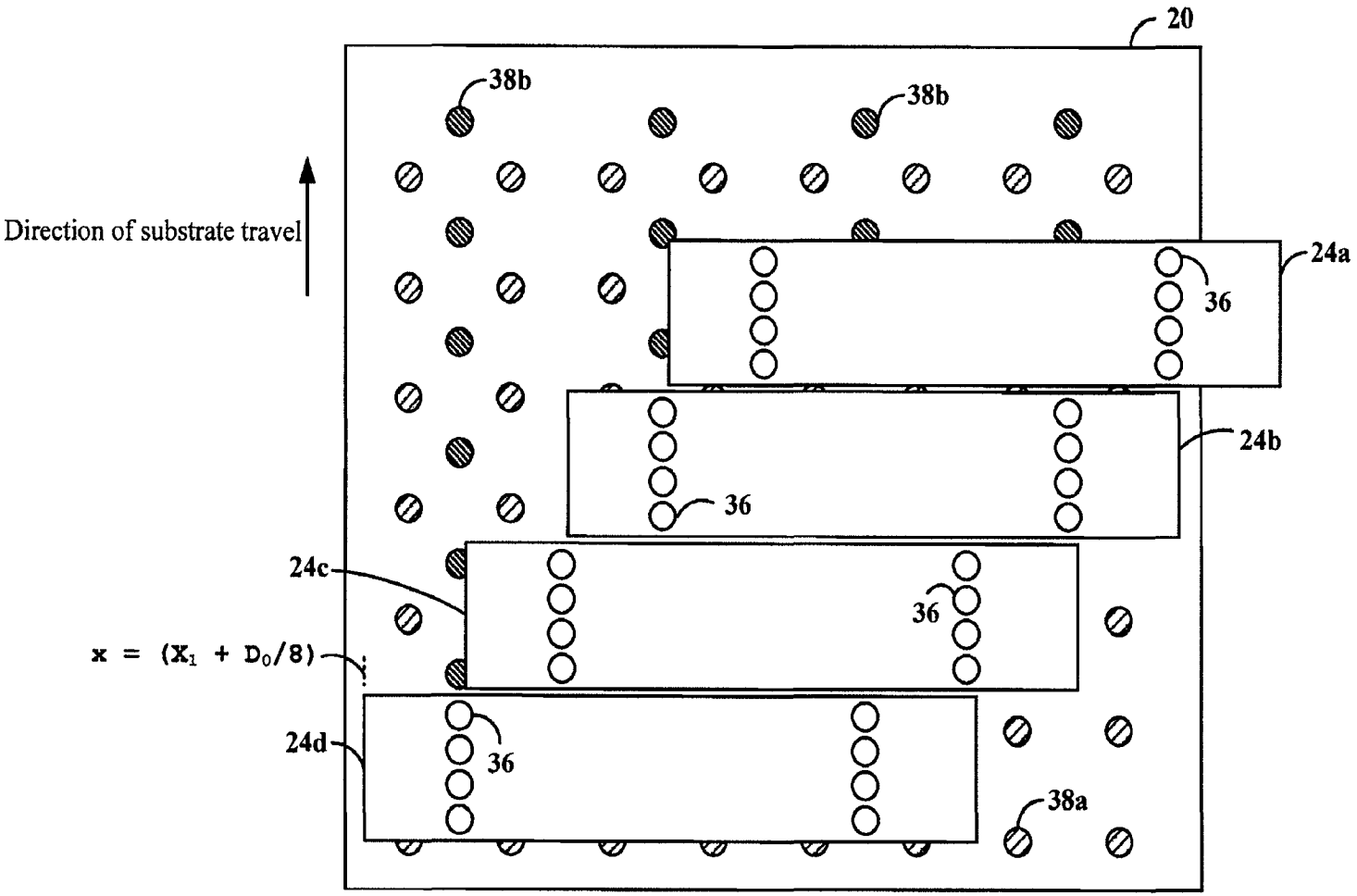

Persons of ordinary skill in the art will further understand that apparatus and methods of this invention may be used to print at non-integer multiples of the native resolution $R_0$ of print head 24, and all print heads 24 may not be used during each printing step. For example, as shown in FIG. 12A, during a first pass, the group of print head arrays 34*a*-34*d* is located at a first x-axis position, $x=X_1$, substrate 20 moves in a first direction, and print heads 24*a*-24*d* print a first image 38*a* on substrate 20. Next, as shown in FIG. 12B, during a second pass, the group of print head arrays 34*a*-34*d* is located at a second x-axis position, $x=(X_1+D_0/8)$, substrate 20 moves in a second direction, and print heads 24*b* and 24*d* print a second image 38*b* on substrate 20, while print heads 24*a* and 24*c* are inactive. Thus, after two passes, the group of print head arrays 34*a*-34*d* print images 38*a* and 38*b* on substrate 20 at a composite resolution of $(8/3)\times R_0$ (e.g., 100 DPI) across the entire width of substrate 20.

Figure 13A:
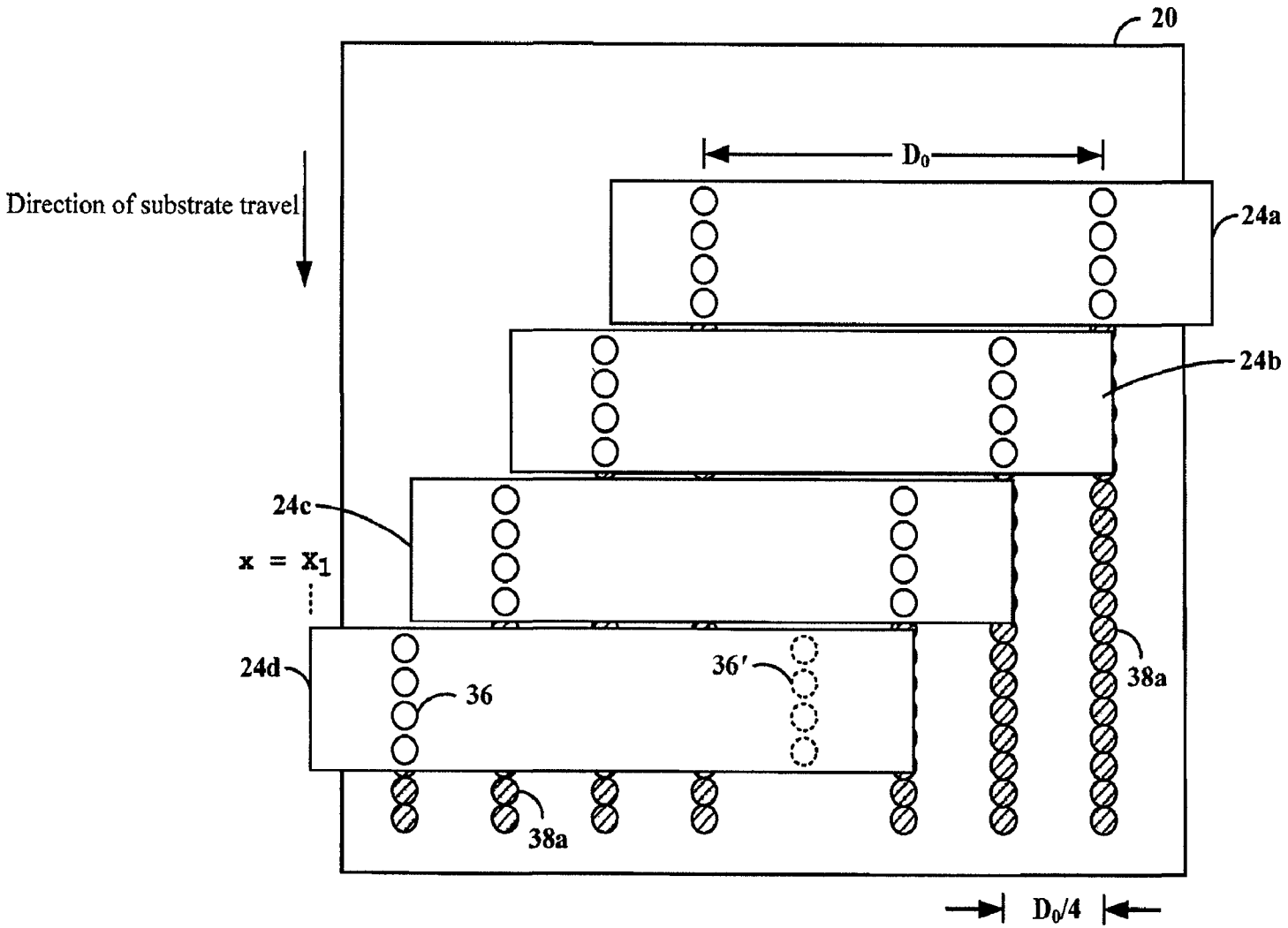
FIG. 13A-13B are simplified views of an exemplary method of interlaced printing in accordance with this invention.

Apparatus and methods in accordance with this invention also may be used to print images on substrate 20 even if one or more inkjet nozzles 36 are defective or inactive. For example, FIG. 13A illustrates a group of print heads 24*a*-24*d* offset in the x-direction by $D_0/4$ from adjacent print heads, for printing at a composite resolution of $4\times R_0$. However, print head 24*d* includes one or more defective inkjet nozzles 36' (shown in dashed lines). The multipass printing techniques of this invention may be used to compensate for such defective inkjet nozzles 36'.

Figure 13B:
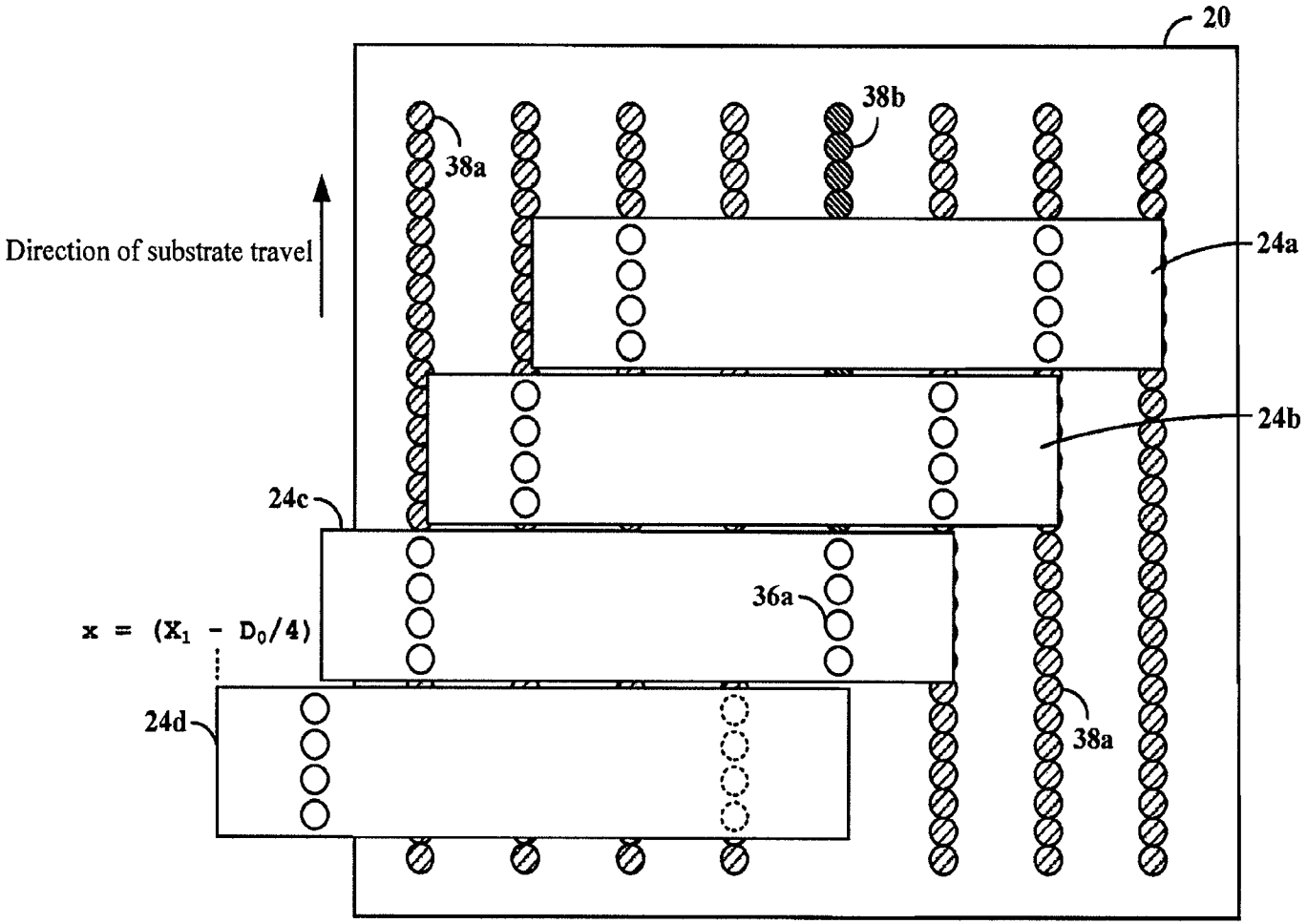

In particular, as shown in FIG. 13A, during a first pass, the group of print heads 24*a*-24*d* is located at a first x-axis position, $x=X_1$, substrate 20 moves in a first direction, and print heads 24*a*-24*d* print a first image 38*a* on substrate 20. Inkjet nozzles 36', however, are deactivated, and do not print any portion of first image 38*a*. Next, as shown in FIG. 13B, during a second pass, the group of print heads 24*a*-24*d* is located at a second x-axis position, $x=(X_1-D_0/4)$, substrate 20 moves in a second direction, and only inkjet nozzles 36*a* of print head 24*c* are used to print a second image 38*b* on substrate 20. In this regard, inkjet nozzles 36*a* of print head 24*c* may be used to fill in the portion of first image 38*a* that could not be completed because of the defective inkjet nozzles 36' on print head 24*d*. Persons of ordinary skill in the art will understand that inkjet nozzles 36 from print heads 24*a* or 24*b* alternatively could have been used to compensate for defective inkjet nozzles 36' by shifting the group of print heads 24*a*-24*d* to an appropriate x-axis position for the second pass.

Figure 14:
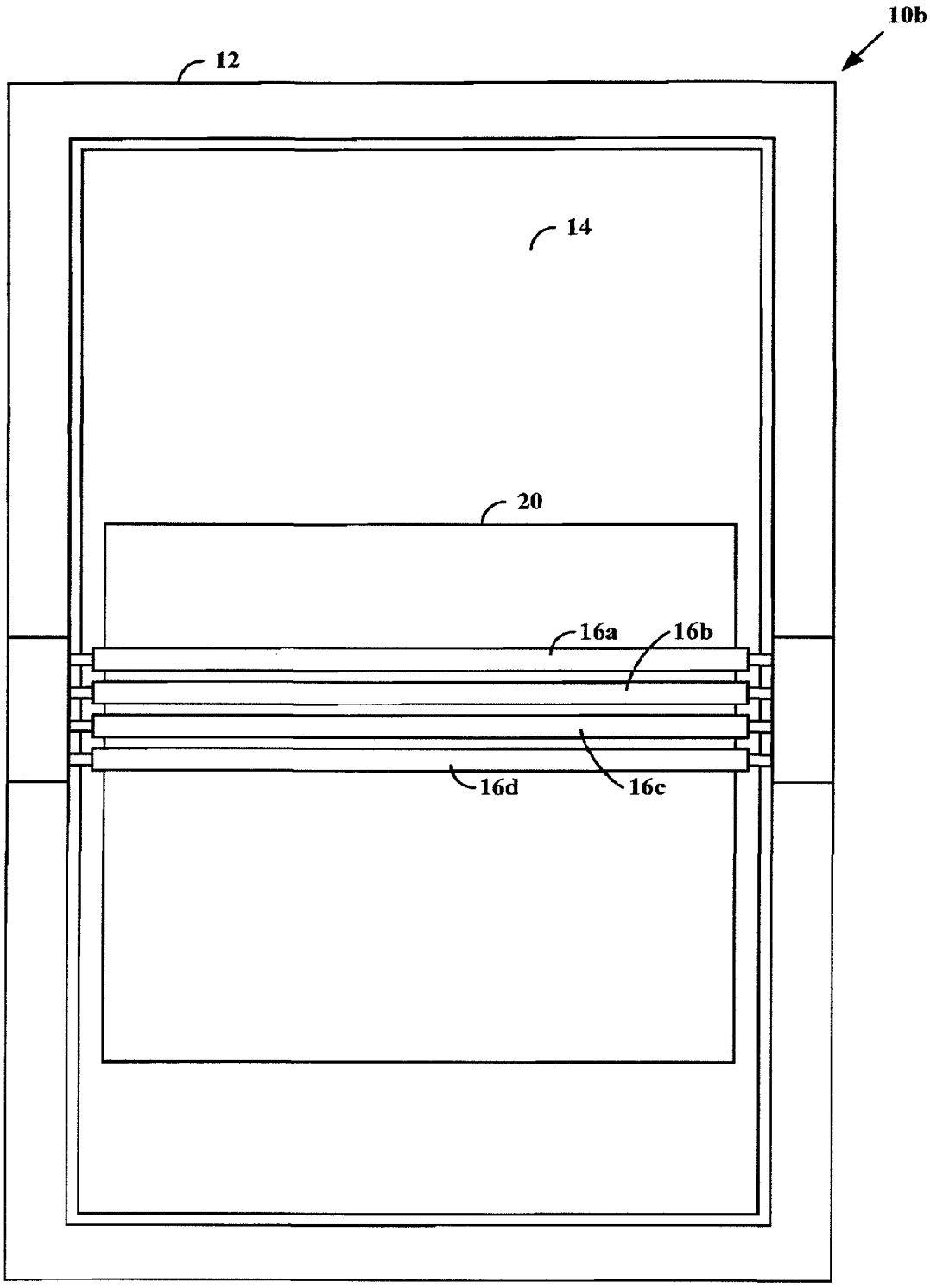
FIG. 14 is a top plan view of an alternative exemplary printer in accordance with this invention.
Figure 15:
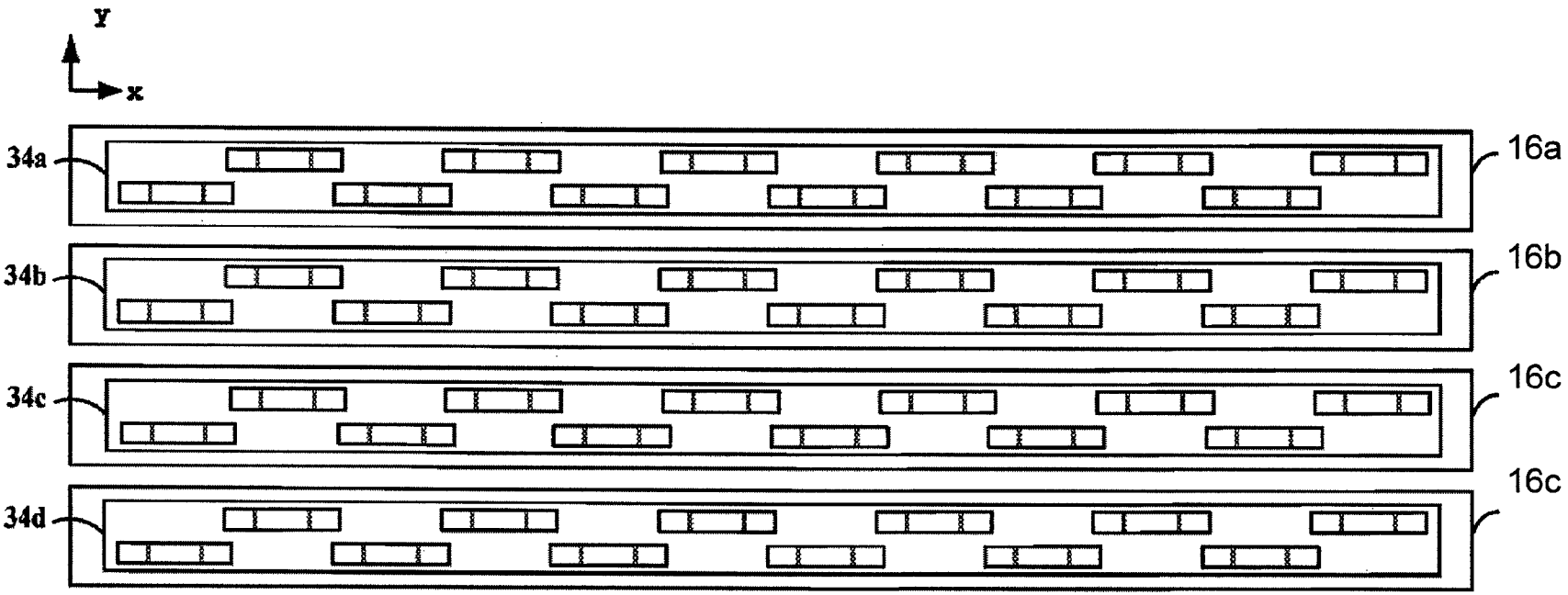
FIG. 15 is a bottom plan view of the support structures of FIG. 14.

In the embodiments described above, multiple print head arrays 34 are grouped together on a single support structure 16, and the group is collectively shifted along the x-axis. Referring now to FIGS. 14-15, an alternative exemplary printer in accordance with this invention is described in which each print head array 34 may be independently shifted along the x-axis. In particular, exemplary printer 10*b* includes multiple support structures 16*a*-16*d*, each of which spans the width W of printer 12 and is used to support one or more print head arrays 34. For example, support structures 16*a*-16*d*, may include print head arrays 34*a*-34*d*, respectively. Further, each support structure 16*a*-16*d*, may be independently shifted to control the x-axis location of print head arrays 34*a*-34*d*.

Figure 16A:
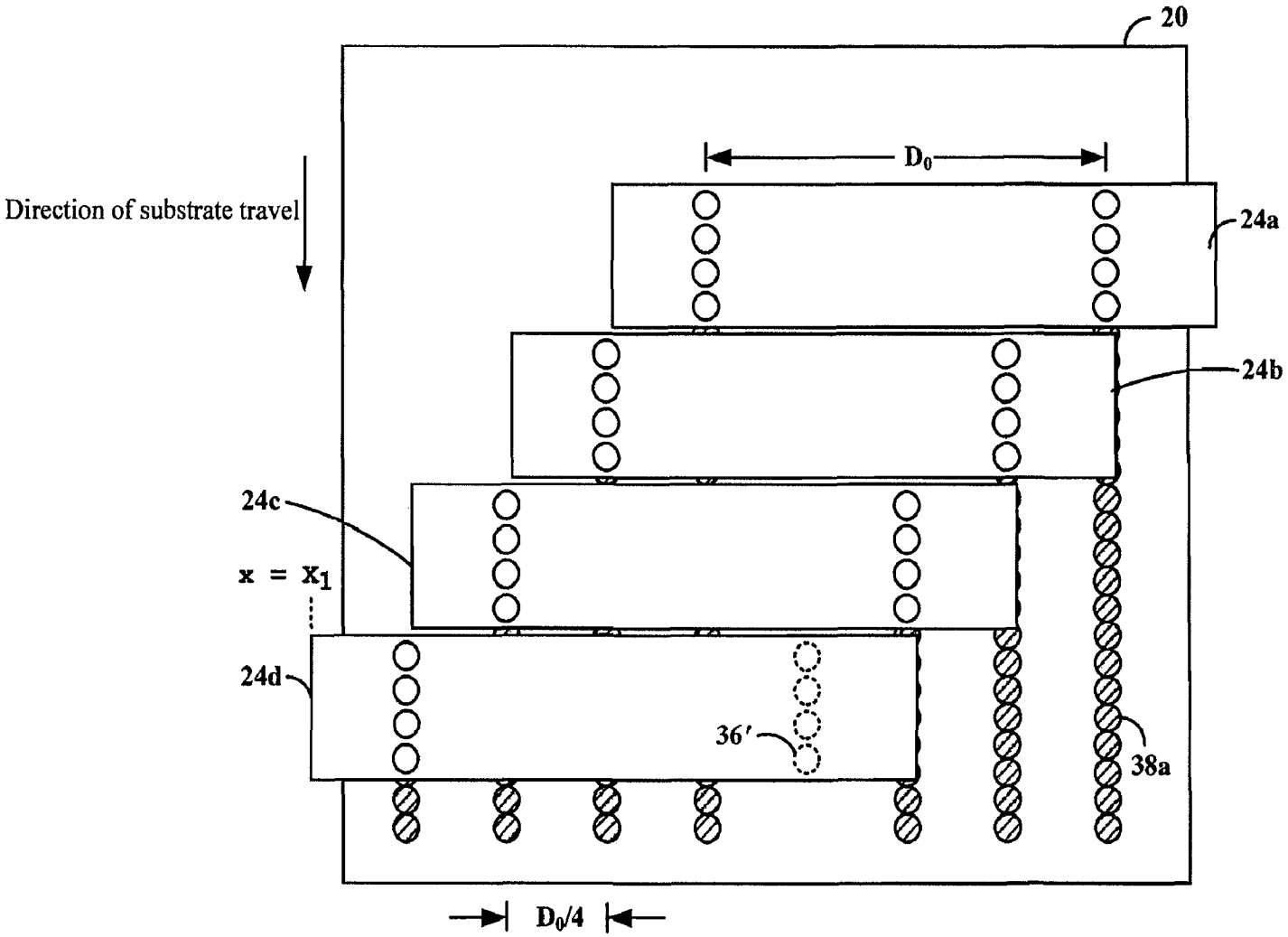
FIGS. 16A-16B are simplified views of an alternative exemplary method of interlaced printing in accordance with this invention.

FIG. 16A illustrates a simplified view of FIG. 15, with a single print head 24*a*-24*d* from each of print head arrays 34*a*-34*d*, respectively. In this example, each print head array 34 has a native resolution $R_0=1/D_0$. Further, support structures 16*a*-16*d* may be individually positioned so that print head arrays 34*a*-34*d* provide a continuous resolution of $4\times R_0$ (e.g., 150 DPI). In addition, multipass printing techniques of this invention may be used to compensate for defective inkjet nozzles, such as inkjet nozzles 36' on print head 24*d*.

Figure 16B:
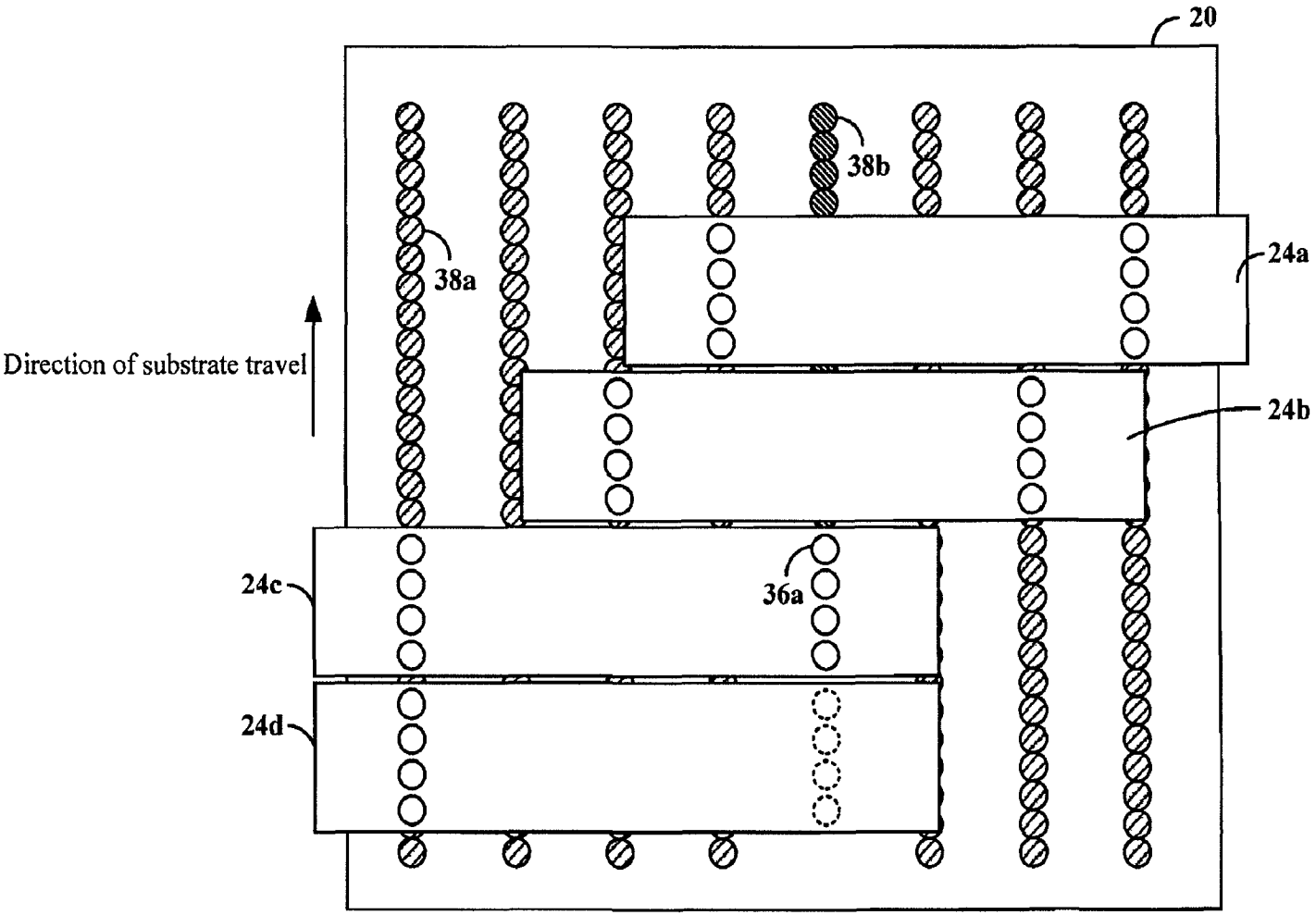

In particular, during a first pass, support structures 16*a*-16*d* are individually positioned so that print head 24*d* is at a first x-axis position, $x=X_1$, and all other print heads 24*b*-24*d* are positioned to provide a continuous resolution of $4\times R_0$. As substrate 20 moves in a first direction, print heads 24*a*-24*d* print a first image 38*a* on substrate 20. Inkjet nozzles 36', however, are deactivated, and do not print any portion of first image 38*a*. Next, as shown in FIG. 16B, during a second pass, support structures 16*a*-16*d* are individually positioned so that print head 24*c* is located at a the first x-axis position, $x=X_1$. As substrate 20 moves in a second direction, only inkjet nozzles 36*a* of print head 24*c* are used to print a second image 38*b* on substrate 20. In this regard, inkjet nozzles 36*a* of print head 24*c* may be used to fill in the portion of first image 38*a* that could not be completed because of the defective inkjet nozzles 36' on print head 24*d*. Persons of ordinary skill in the art will understand that inkjet nozzles 36 from print heads 24*a* or 24*b* alternatively could have been used to compensate for defective inkjet nozzles 36' by shifting print heads 24*a* or 24*b* to an appropriate x-axis position for the second pass.

Figure 17:
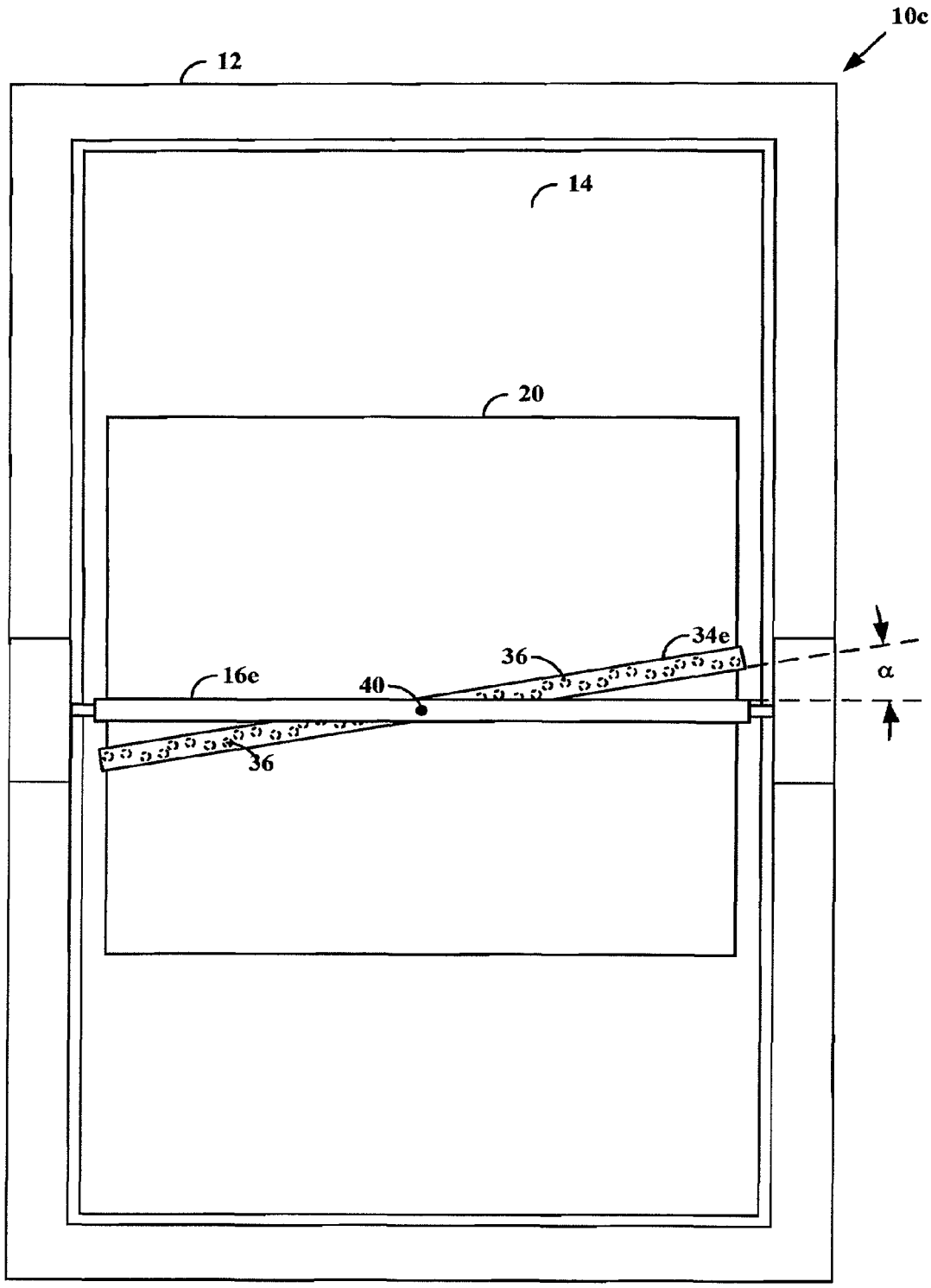
FIG. 17. is a top plan view of another alternative exemplary printer in accordance with this invention.

In the embodiments described above, one or more print head arrays 34 are disposed on one or more support structures 16, and the print head arrays are shifted individually or collectively along the x-axis to achieve a desired composite resolution that exceeds the native resolution of each print head. Referring now to FIG. 17, another exemplary printer in accordance with this invention is described in which print head arrays are rotated about an axis to achieve any desired print resolution. In particular, exemplary printer 10*c* includes support structure 16*e* that spans the width W of printer 12 and is used to support a print head array 34*e* that includes multiple print heads (not shown) that have inkjet nozzles 36 disposed to provide a continuous resolution of $R_0$ across the entire width of substrate 20. In addition, print head array 34*e* is coupled to support structure 16*e* at pivot point 40, and may be rotated about the pivot point by an angle $\alpha$. As $\alpha$ increases from 0 to 90°, the x-axis resolution increases. In this regard, by controlling the pivot angle $\alpha$, any desired print resolution may be achieved.

Figure 18:
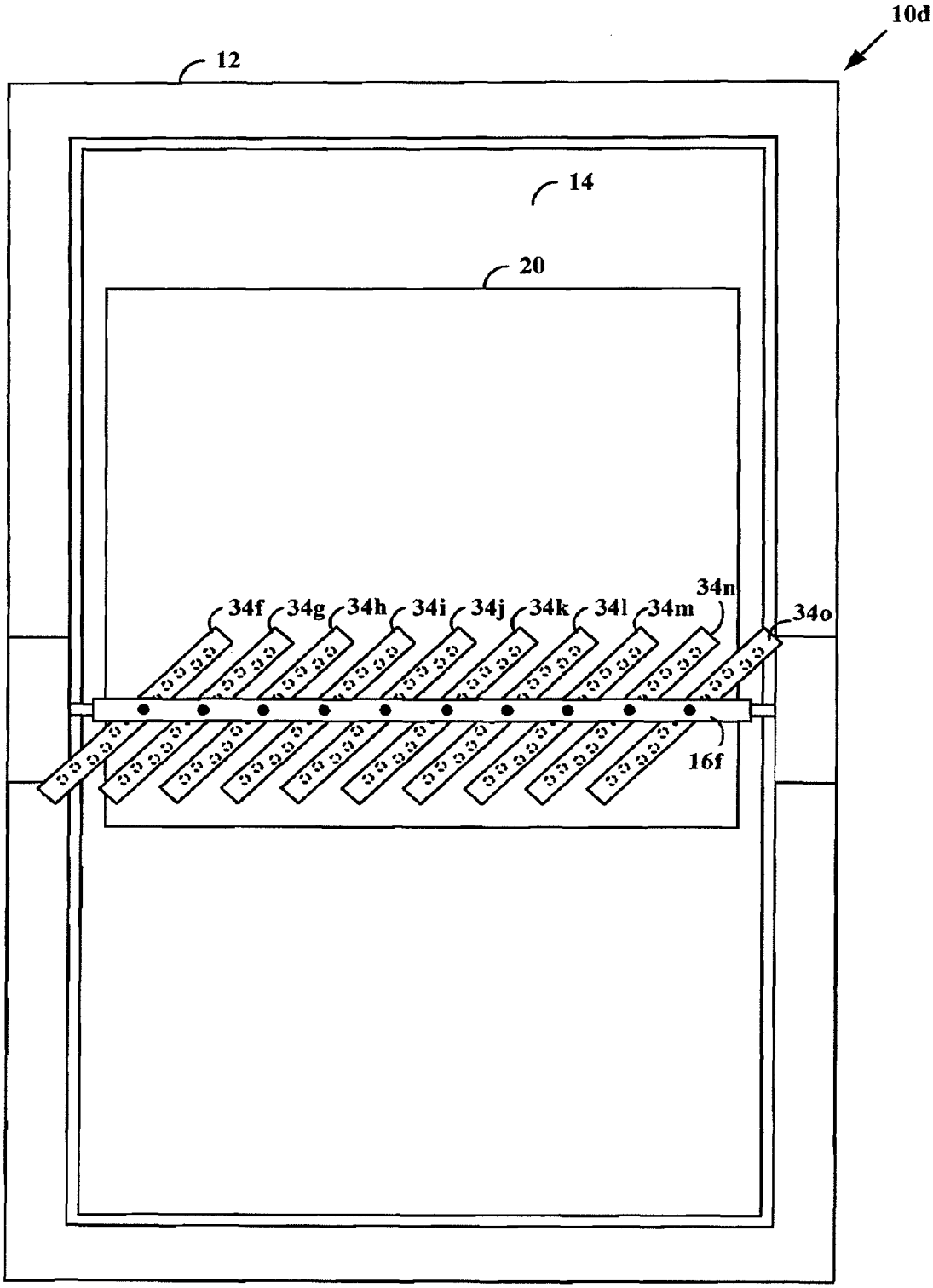
FIG. 18 is a top plan view of yet another alternative exemplary printer in accordance with this invention.

FIG. 18 illustrates another exemplary printer in accordance with this invention that uses multiple pivotable print head arrays 34*f*-34*o*. In particular, exemplary printer 10*d* includes support structure 16*f* that spans the width W of printer 12 and is used to support print head arrays 34*f*-34*o* that each include multiple print heads (not shown) that have inkjet nozzles 36 disposed to provide a resolution $R_0$ across the entire width of substrate 20. Print head arrays 34*f*-34*o* are coupled to support structure 16*f* at pivot points and may be individually rotated about their respective pivot points to provide any desired print resolution. Multiple print head arrays 34*f*-34*o* increase the printing width that may be achieved when using very high pivot angles.

The foregoing merely illustrates the principles of this invention, and various modifications can be made by persons of ordinary skill in the art without departing from the scope and spirit of this invention.

The invention claimed is:

1. A printer comprising:

a conveyor defining an X direction (W) and a Y direction (L) perpendicular to the X direction, the conveyor configured to receive a substrate of maximum width W2 in the X direction and to move the substrate linearly in the Y direction;

a first array of multiple inkjet print heads distributed along a length of the first array;

where the print heads have a prescribed native resolution and a prescribed dot pitch;

at least one support, spanning the conveyor in the X direction, where the first array is pivotably mounted at its midpoint to the support, where the first array is pivotable about an axis perpendicular to the X and Y directions, and where during printing the array is pivoted sufficient to reduce and compress a width of printing applied in the X direction and causing printing to occur in greater resolution than said native resolution.

2. The printer of claim 1, further comprising one or more elongated ink curing stations residing substantially parallel to the support and substantially spanning the width W2.

3. The printer of claim 1, where the first array substantially spans the width W2.

4. The printer of claim 1, further comprising one or more additional arrays of multiple inkjet print heads mounted to the support at different pivot points distributed along the X direction such that pivoting of the arrays reduces spacing between printing of the ink jets in the X direction to cause printing in greater resolution than a native resolution of the inkjet print heads of the arrays individually.

5. The printer of claim 4, where the first array and the additional arrays are pivotable independently of each other.

6. A printing process utilizing a printer including a conveyor defining an X direction (W) and a Y direction (L) perpendicular to the X direction, the conveyor configured to receive a substrate of maximum width W2 in the X direction and to move the substrate linearly in the Y direction, the printer further including a first array of multiple inkjet print heads distributed along a length of the first array, where the print heads have a prescribed native resolution and a prescribed dot pitch, the process comprising:

providing at least one support spanning the conveyor in the X direction, where the first array is pivotably mounted at its midpoint to the support, where the first array is pivotable about an axis perpendicular to the X and Y directions;

during printing, pivoting the array sufficient to reduce and compress a width of printing applied in the x direction and causing printing to occur in greater resolution than said native resolution.

7. The process of claim 6, further comprising providing one or more elongated ink curing stations residing substantially parallel to the support and substantially spanning the width W2.

8. The process of claim 6, where the first array substantially spans the width W2.

9. The process of claim 6, further comprising:

providing one or more additional arrays of multiple inkjet print heads mounted to the support at different pivot points distributed along the X direction;

pivoting the arrays to reduce spacing between printing of the ink jets in the X direction to cause printing in greater resolution than a native resolution of the inkjet print heads of the arrays individually.

10. The process of claim 9, further comprising pivotably positioning the arrays independent of each other.

11. The process of claim 9, further comprising shifting the arrays in the X direction in order to compensate for one or more defective inkjet nozzles in the arrays.

* * * * *